US011208239B2

(12) United States Patent
French et al.

(10) Patent No.: US 11,208,239 B2
(45) **Date of Patent: *Dec. 28, 2021**

(54) SELECTIVE FLOW MEMBER FOR A CONTAINER

(71) Applicant: Berry Global, Inc., Evansville, IN (US)

(72) Inventors: Jordan Robert French, Evansville, IN (US); Seth Tempel, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/704,775

(22) Filed: Dec. 5, 2019

(65) Prior Publication Data

US 2020/0108984 A1 Apr. 9, 2020

Related U.S. Application Data

(63) Continuation of application No. 16/196,073, filed on Nov. 20, 2018, now Pat. No. 10,532,863.

(60) Provisional application No. 62/588,476, filed on Nov. 20, 2017.

(51) Int. Cl.
*B65D 47/26* (2006.01)
*B65D 47/04* (2006.01)

(52) U.S. Cl.
CPC ..... *B65D 47/266* (2013.01); *B65D 47/043* (2013.01); *B65D 47/265* (2013.01); *B65D 2251/0025* (2013.01); *B65D 2251/0087* (2013.01)

(58) Field of Classification Search
CPC .. B65D 47/266; B65D 47/265; B65D 47/043; B65D 2251/0025; B65D 2251/008
USPC .... 222/454, 443, 428, 424.5, 427, 452, 453, 222/457.5, 142.2, 162.4, 142.6, 142.9, 222/144.5
See application file for complete search history.

(56) References Cited

U.S. PATENT DOCUMENTS

| | | | | |
|---|---|---|---|---|
| 4,345,700 | A * | 8/1982 | Souza | G01F 11/46 222/438 |
| 5,029,736 | A * | 7/1991 | Maruyama | G01F 11/26 222/455 |
| 6,550,640 | B2 * | 4/2003 | Smith | G01F 11/22 222/1 |
| 9,395,225 | B2 * | 7/2016 | Skillin | B65D 47/0847 |
| 10,329,059 | B1 * | 6/2019 | Heilman | B65D 21/0204 |
| 2003/0136187 | A1 * | 7/2003 | Cousseau | G01F 11/262 73/149 |
| 2003/0209572 | A1 * | 11/2003 | Myers | G01F 11/44 222/452 |
| 2011/0163132 | A1 * | 7/2011 | Moreau | G01F 11/263 222/454 |
| 2015/0028063 | A1 * | 1/2015 | Skillin | G01F 11/262 222/455 |
| 2015/0083758 | A1 * | 3/2015 | Ismail | B67D 7/22 222/434 |
| 2018/0094959 | A1 * | 4/2018 | Gieske | G01F 11/261 |

* cited by examiner

*Primary Examiner* — Lien M Ngo

(57) ABSTRACT

A flow selector configured for selectively or optionally regulating flow of liquid from a container is disclosed.

20 Claims, 17 Drawing Sheets

SELECTIVE FLOW MEMBER FOR A CONTAINER

PRIORITY CLAIM

This application is a continuation of U.S. application Ser. No. 16/196,073, filed Nov. 20, 2018, which claims priority under 35 U.S.C. § 119(e) to U.S. Provisional Application Ser. No. 62/588,476, filed Nov. 20, 2017, each of which is expressly incorporated by reference herein.

TECHNICAL FIELD

The present disclosure relates generally to an apparatus for selectively adjusting flow of contents, and more specifically to a selective flow member configured to adjust flow from a container.

BACKGROUND

It is often desirable to control or regulate the amount or volume of flow from a container. Flow regulators or limiters may be included in a container, for example, between the body of the container and an opening or outlet. However, such flow regulators or limiters often do not allow free or substantially unrestricted flow, are generally permanent, and/or are inconvenient to remove. This may make it difficult to select between freely pouring the contents of the container and pouring the contents in a meter or dosed fashion, as desired.

SUMMARY

One or more embodiments in accordance with the present disclosure may address one or more of the aforementioned problems. Certain embodiments according to the present disclosure provide a flow selector for a container that is configured to be movable between a free pour mode or position and a regulated flow mode or position.

In one aspect, for instance, some embodiments may provide a selectively flow regulating container that includes a container having a base, a side wall, and a container opening. The base and the side wall may define a product storage region. The flow regulating container may include a flow regulator coupled to the container and disposed adjacent the container opening. The flow regulator may include a first member and a second member, wherein the first member is movable relative to the second member between a regulated flow position and a free flow position. The first member may have a first wall defining a first chamber and a first opening in the first wall, and the second member may have a second wall defining a second chamber and a second opening in the second wall. In the regulated flow position, the product storage region may be in fluid communication with the first chamber via an open area provided by alignment of the first opening and the second opening when the container is inverted, and the second chamber may be in fluid communication with an exterior of the container via a dispensing outlet when the container is inverted. In the regulated flow position, the first chamber may be in fluid communication with the second chamber when the container is upright. In the regulated flow position, a flow directly from the product storage region to the exterior of the container may be substantially blocked by at least one of the first member and the second member, which may cooperate to redirect the flow through at least one of the first chamber and the second chamber in the regulated flow position. In the free flow position, the product storage region may be in substantially direct fluid communication with the dispensing outlet of the container.

In another aspect, for instance, some embodiments may provide a flow regulating container that includes a container having a base, a container side wall, and a container opening. The base and the side wall may define a product storage region. A flow regulator may be coupled to the container adjacent the container opening, the flow regulator having a first member that is movable relative to a second member between a regulated flow position and a free flow position. The first member may be configured to receive a user input to selectively move the first member between the regulated flow position and the free flow position. The first member may have a first side wall with a first side wall opening and a lid with a lid opening. The second member may have a second side wall cooperating with the side wall of the container to define a first flow channel. In the regulated flow position the lid of the first member may be configured to block flow from the first flow channel to an exterior of the container while the first side wall opening and the second side wall opening are at least partially aligned to allow fluid communication from the first flow channel into a first chamber defined by the first side wall of the first member. The first member may have a bottom opening in fluid communication with a second chamber defined by the second side wall and a floor of the second member. The second chamber may be in fluid communication with dispensing outlet of the container via a second flow channel, wherein the lid opening of the first member is at least partially aligned with the second flow channel while in the regulated flow position to allow pouring of the contents of the second chamber out of the container.

In yet another aspect, for instance, some embodiments may provide a selective flow regulator that includes a first member and a second member configured to be rotationally coupled to the first member. The coupled first member and second member may be configured to be inserted together into an opening of a container. The first member may have a first side wall at least partially defining an inner chamber, the first side wall having a first opening, and the first member having a floor at least partially defining a floor opening. The second member may have a second side wall at least partially defining an outer chamber, the second side wall having a second opening. The first member may be selectively rotatable by a first user input relative to the second member between a regulated flow position and a free flow position, and the first and second members may be movable by a second user input between an upright position and an inverted position. In the upright position, the inner chamber may be above the outer chamber and in the inverted position the inner chamber may be below the outer chamber. The first member may have a lid configured to block flow out of the first member except at a lid opening configured for dispensing contents through the lid. In the free flow position, a first channel may be at least partially defined by the first side wall and the second side wall and external to the first side wall and the second side wall. In the free flow position, fluid flow from the first channel to the inner chamber may be blocked while the pour opening is in fluid communication with the first channel to allow fluid flow from the first channel through the lid opening. In the regulated flow position, the lid of the first member may block fluid flow from exiting the lid directly from the first channel. The first side wall opening and the second side wall opening may be at least partially aligned to allow fluid communication between the first channel and the inner chamber when the first and second members are in the inverted position. The floor opening in the first member may at least partially provide fluid communication between the inner chamber and the outer chamber at least when the first and second members are in the upright position. A second flow channel may be at least partially defined by the first side wall and the second side wall and between the first side wall and the second side wall. The second flow channel may be in fluid communication with the outer chamber and the lid opening when in the regulated flow position to allow fluid flow from the outer chamber through the second flow channel and through the pour opening when in the inverted position.

BRIEF DESCRIPTION OF THE DRAWINGS

Embodiments now will be described more fully hereinafter with reference to the accompanying drawings, in which some, but not all embodiments are shown. Indeed, embodiments may be illustrated or described in many different forms and the present disclosure should not be construed as limited to the embodiments set forth herein; rather, these embodiments are provided so that this disclosure will satisfy applicable legal requirements. Like numbers refer to like elements throughout, and wherein.

DETAILED DESCRIPTION

Embodiments now will be described more fully hereinafter with reference to the accompanying drawings, in which some, but not all embodiments are shown. Indeed, embodiments may take many different forms and the present disclosure should not be construed as limited to the embodiments set forth herein. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
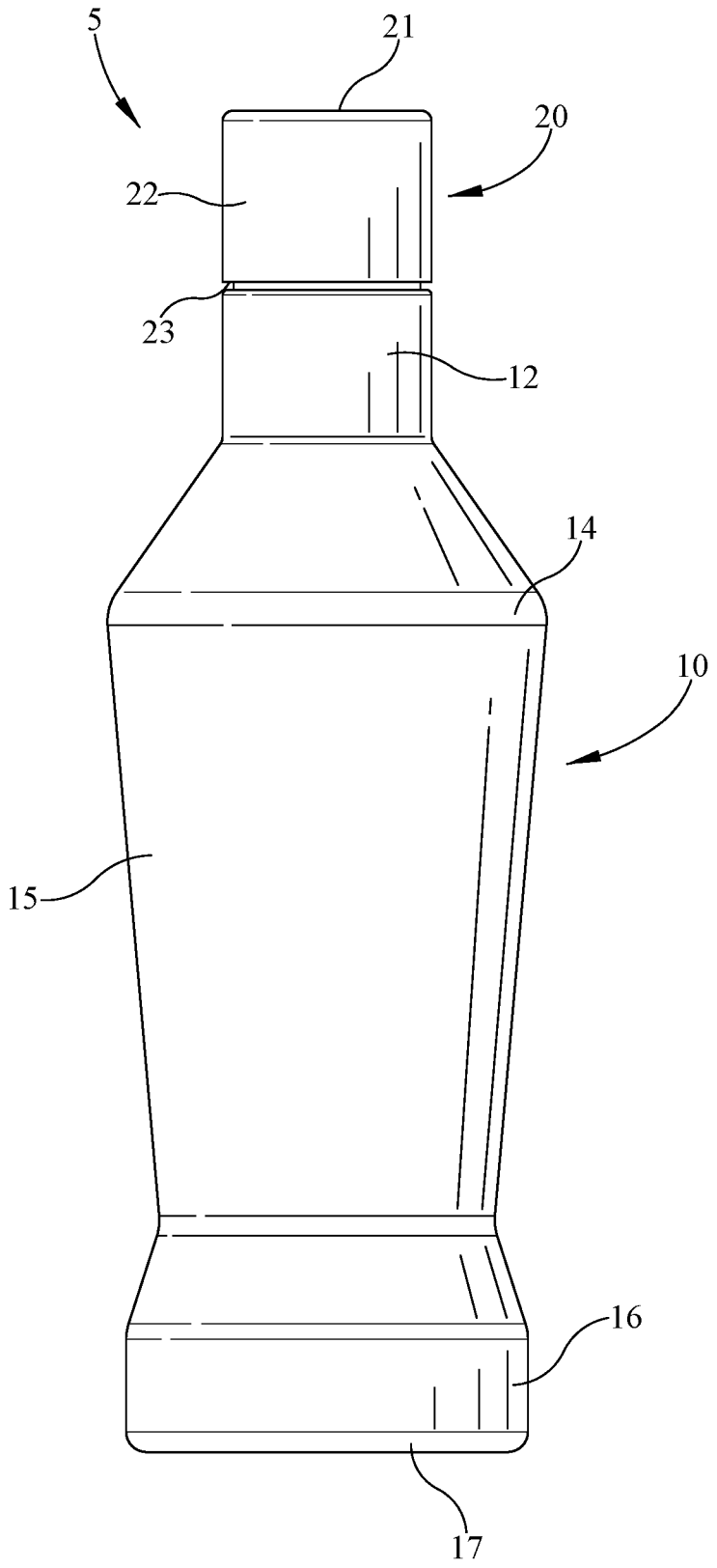
FIG. 1 illustrates a front view of an exemplary embodiment of a selective flow package.
Figure 4:
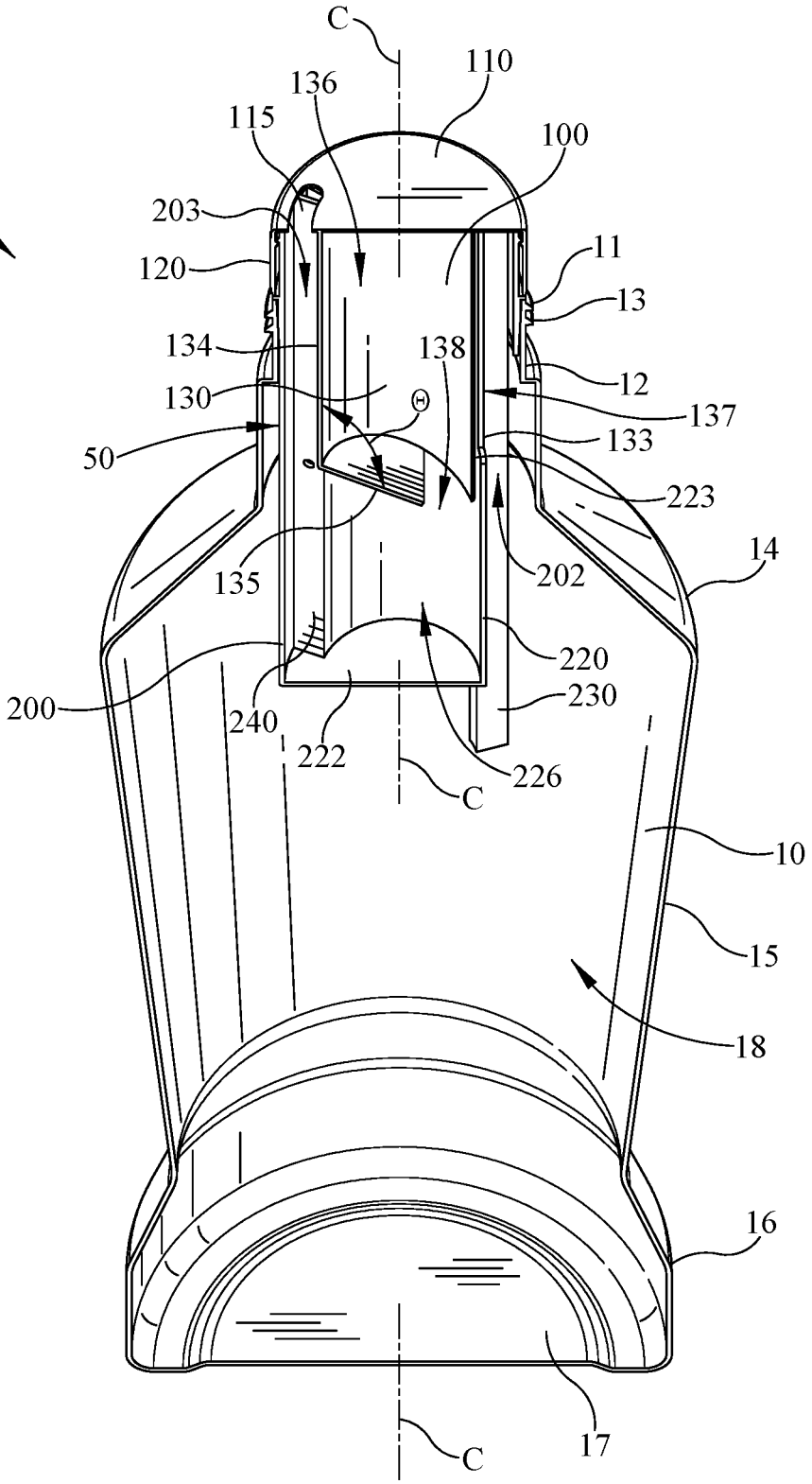
FIG. 4 illustrates a section view of the selective flow package of FIG. 1, shown without the cap and illustrating an exemplary embodiment of a flow selector in an exemplary regulated flow mode inserted into the neck of the container.

Some embodiments of a selective flow package or container 5 may include, be coupled to, and/or used with any of a variety of containers or packaging articles, such as, for example, containers or bottles for holding liquid contents therein, such as a container 10 as illustrated in FIG. 1. While any of a variety of bottles, containers, or packages may be included with selective flow container 5 without limitation, the exemplary embodiment shown in FIG. 1 depicts container 10 having a neck 12, body 15, shoulder 14, base 16, and bottom 17. Container 10 or any component thereof may define a product storage region 18 (not shown in FIG. 1) disposed inside container 10 and configured to hold any of a variety of contents. For example, container 10 and/or product storage region 18 may be adapted and/or configured to store, for example, liquid contents such as a liquid product or beverage 19. FIG. 4 illustrates a substantially empty product storage region 18, and FIGS. 16*a*-17 illustrate a product storage region 18 with exemplary beverage 19 at least partially stored therein.

As shown in FIG. 1, selective flow container 5 may include a cap 20 coupled to container 10 or a portion thereof, such as neck 12. Cap 20 may be included for any of a variety of reasons, such as, for example, to selectively enclose container 10 and/or product storage region 18 to hold or retain contents such as liquid contents 19 therein. Cap 20 may be removable so that a user may remove cap 20 to allow adding and/or dispensing of liquid contents 19 from container 10. Cap 20 may be reclosable on container 10 and/or neck 12 so that a user may reclose container 10 and/or product storage region 18, for example, after pouring beverage 19 therefrom to reseal and/or reclose container 10 to retain beverage 19 therein and substantially prevent beverage 19 from evaporating and/or spilling.

Figure 2:
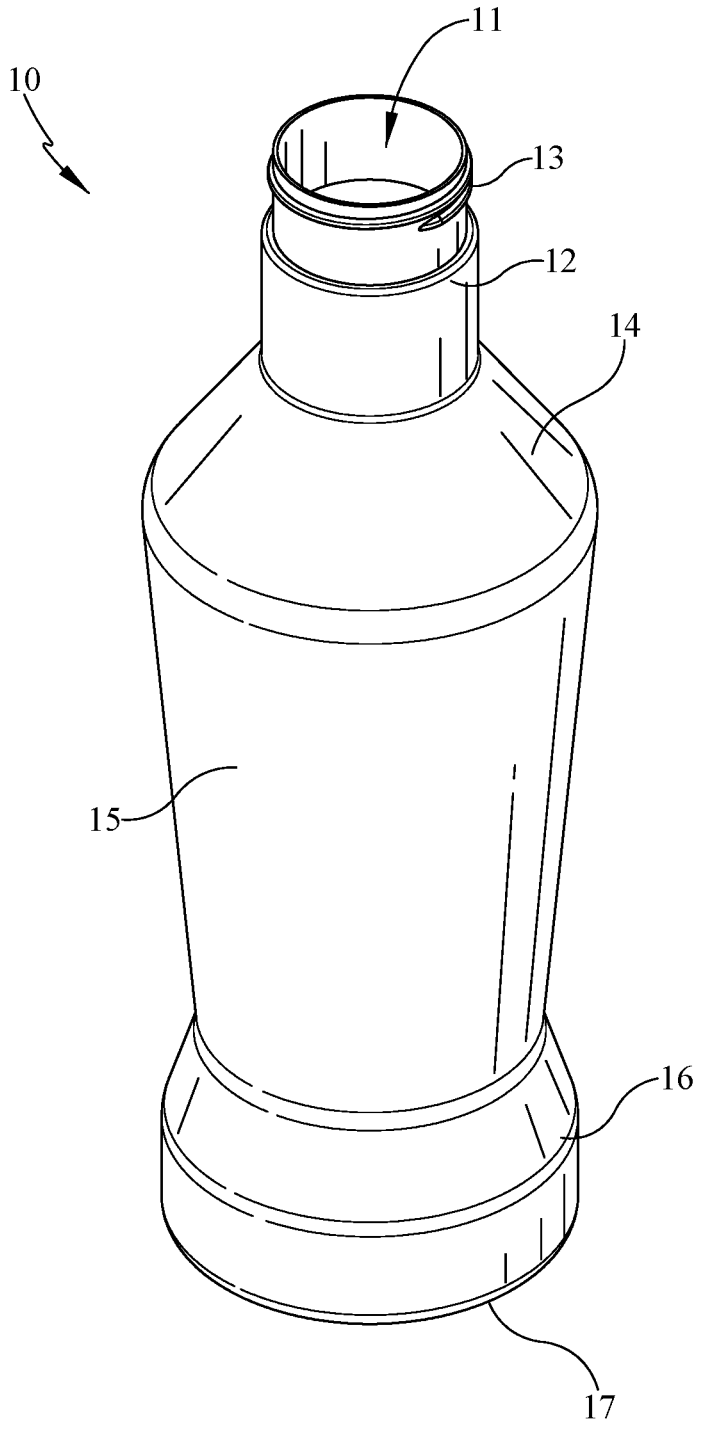
FIG. 2 illustrates a top perspective view of an exemplary embodiment of a container according to the selective flow package of FIG. 1.
Figure 6:
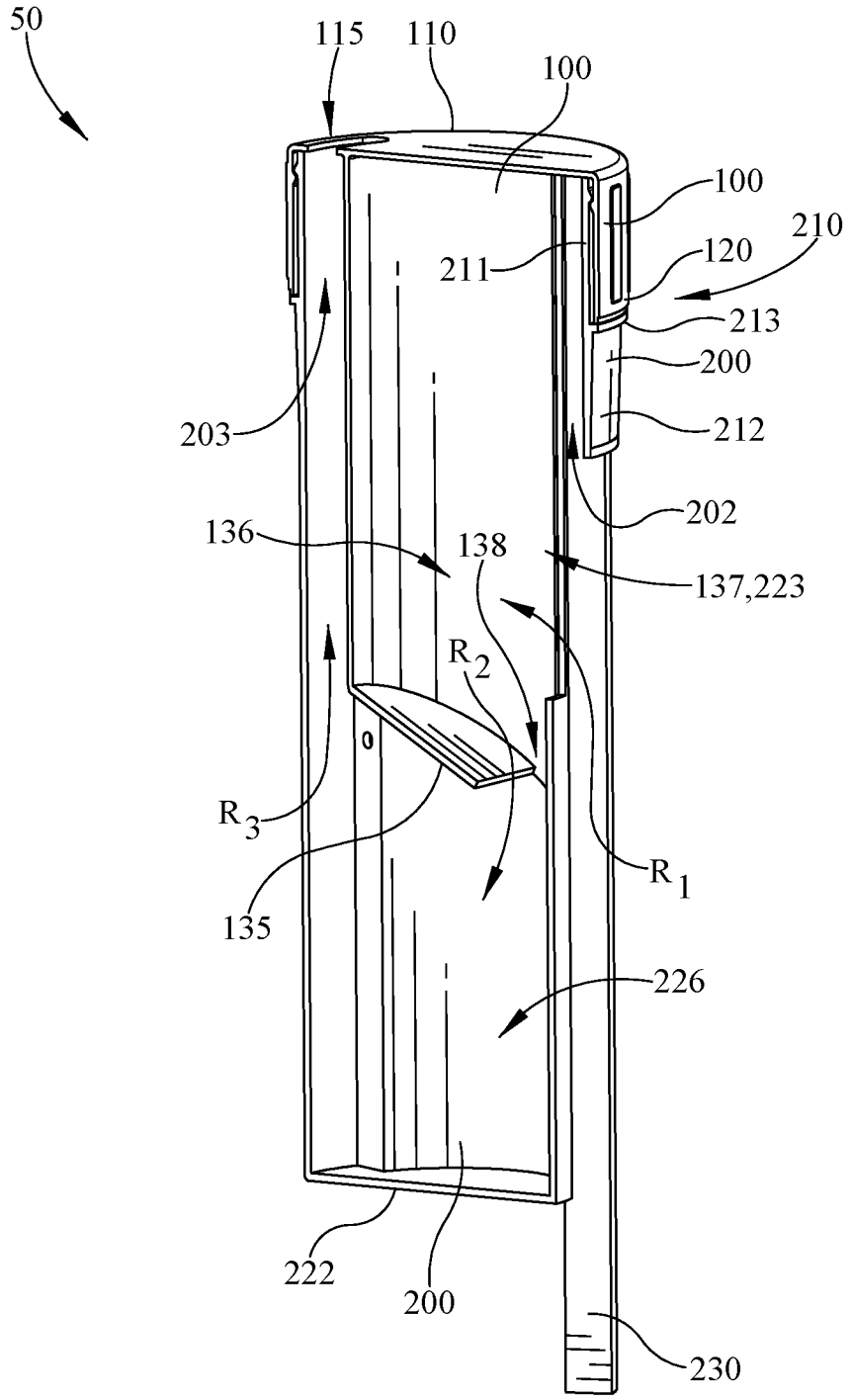
FIG. 6 illustrates a section view of the flow selector of FIG. 4.
Figure 7:
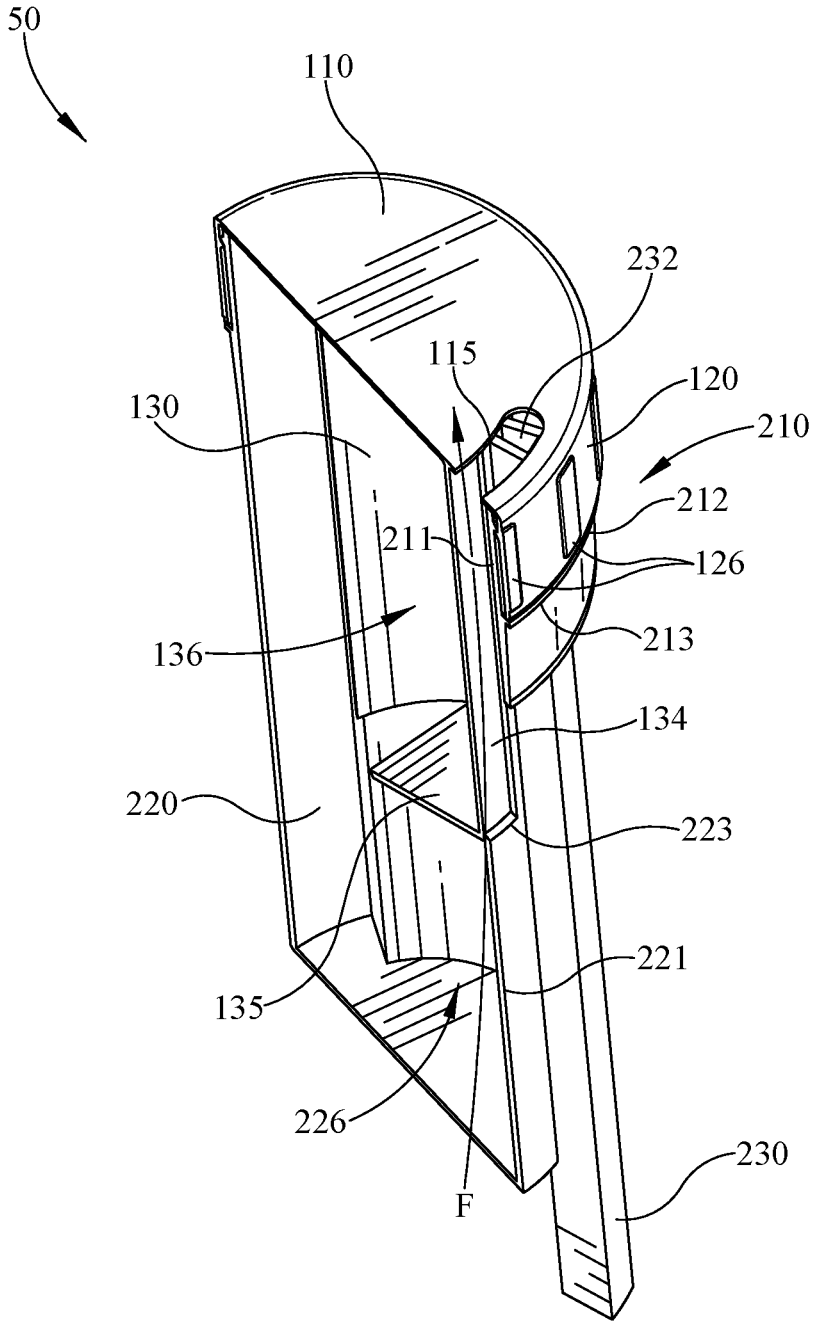
FIG. 7 illustrates a section view of the flow selector of FIG. 5.
Figure 13:
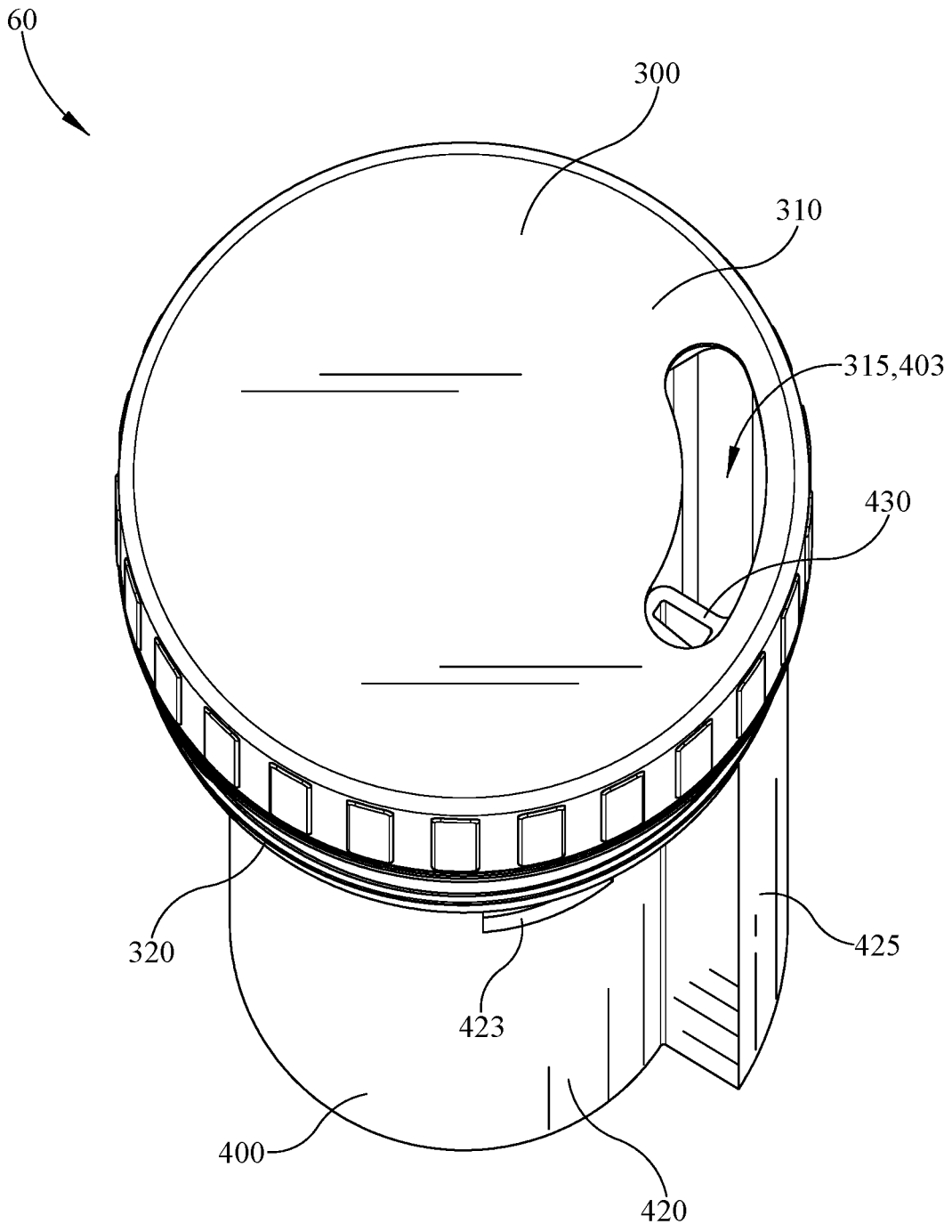
FIG. 13 illustrates a top perspective view of an alternative embodiment of a flow selector.
Figure 14:
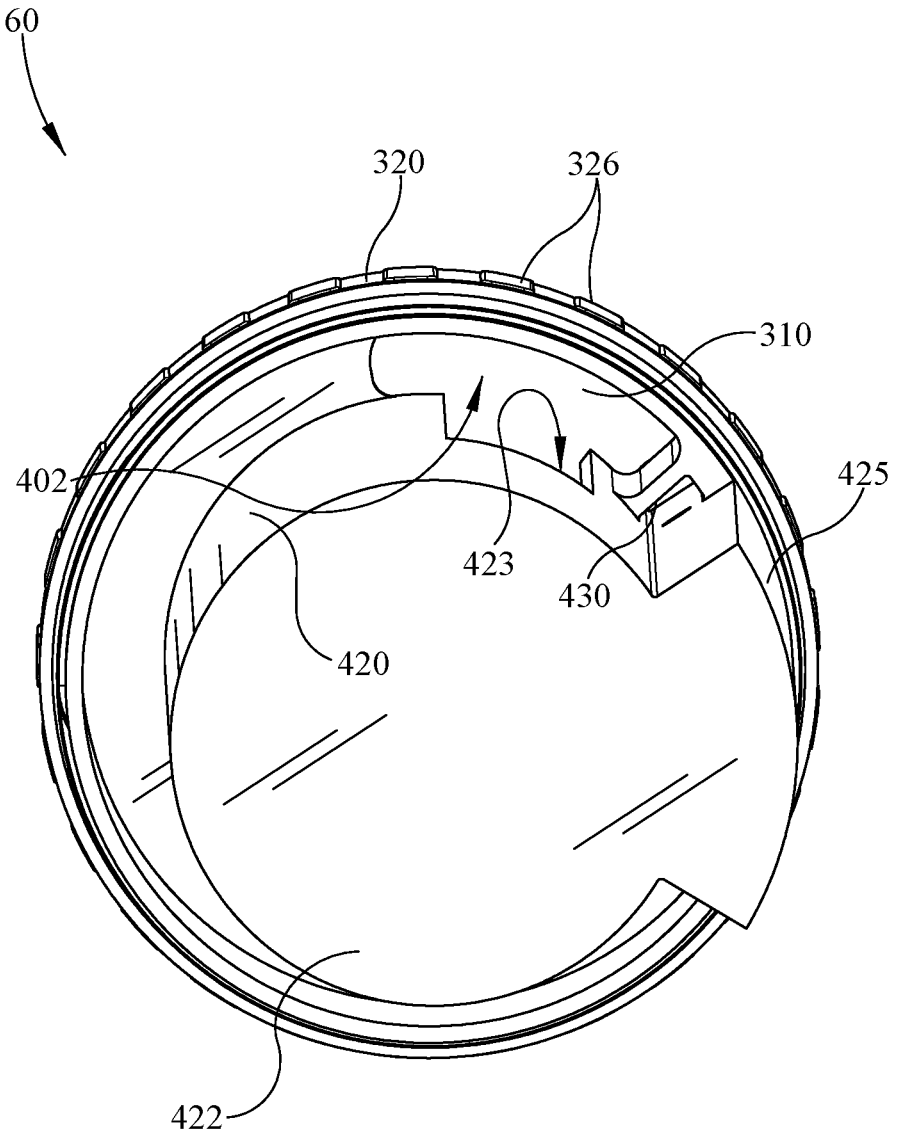
FIG. 14 illustrates a bottom perspective view of the flow selector of FIG. 13.
Figure 15:
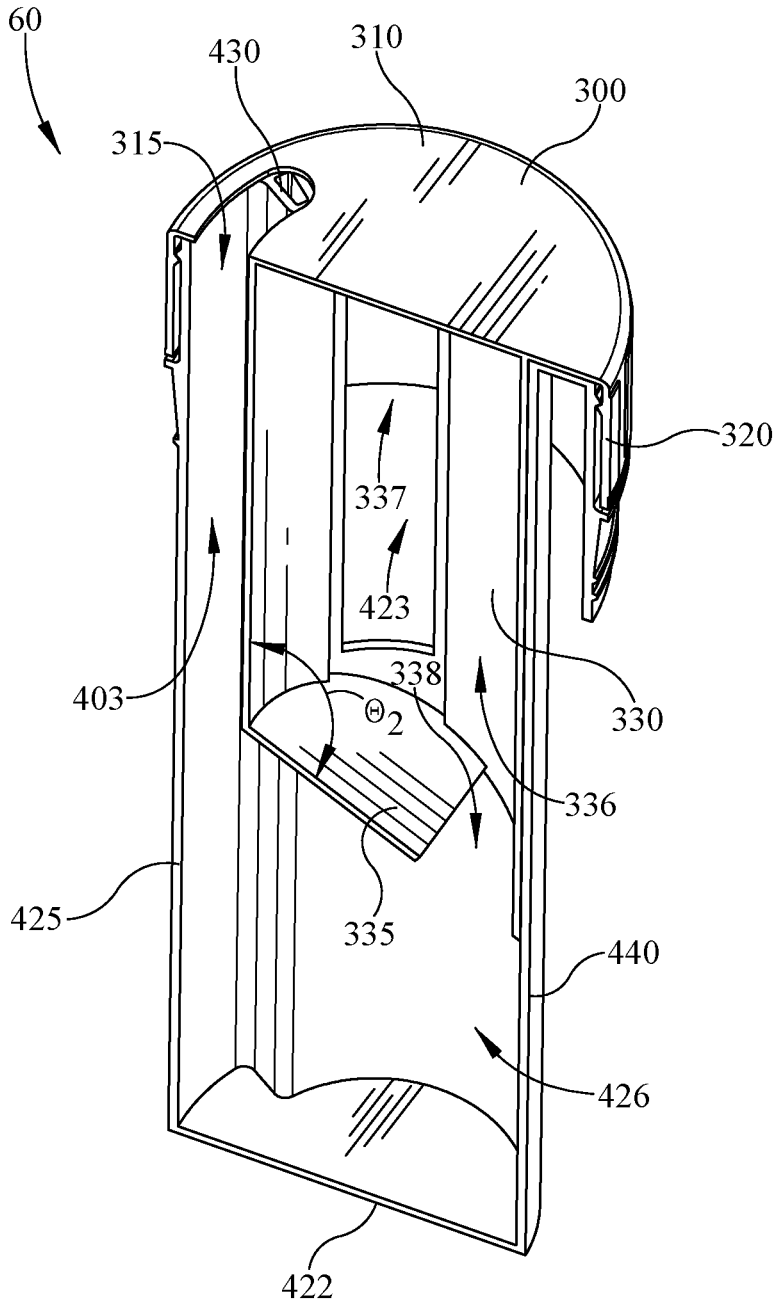
FIG. 15 illustrates a section view of the flow selector of FIGS. 13 and 14.

Container 10 may include an opening 11 such as is illustrated in FIG. 2 that may be configured to allow adding liquid contents 19 to product storage 18 and/or for pouring or dispensing liquid contents 19 from product storage region. Opening 11 may be configured for insertion of and/or coupling with a selective flow regulator or flow selector 50 such as is illustrated in FIGS. 6 and 7, and/or for insertion of and/or coupling with a selective flow regulator or flow selector 60 such as is illustrated in FIGS. 13-15, for example, instead of or in addition to being configured for adding and/or pouring liquid contents 19. For example, opening 11 may be configured to be large enough or have a large enough diameter to allow insertion of some or all of flow selector 50 or any component thereof, while being small enough to facilitate or allow a convenient and/or clean pour, and/or to enhance the aesthetics of container 10 and/or selective flow package 5.

Container 10 may include a mechanism for attachment of or coupling with a closure such as cap 20 as shown in FIG. 2. For example, container 10 may include a neck thread 13 at or near opening 11. Container 10 and/or neck 12 may include one or more alternative attachment or coupling mechanisms instead of or in addition to neck thread 13, such as, for example, a snap fit including a bead, tongue, and/or groove configured to engage or snap fit with a corresponding mechanism on cap 20 such as a bead, tongue, and/or groove. In some embodiments, cap 20 or any portion thereof may form an interference or friction fit with container 10 or any portion thereof, and/or cap 20 and container 10 may be glued, adhered, bonded, and/or otherwise attached or coupled together. Continuing the example wherein neck 12 includes a neck thread 13, neck 12 may be externally threaded or threaded on an exterior surface with neck thread 13, if neck thread 13 is included. If neck 12 is externally threaded with neck thread 13 such as is depicted in the exemplary embodiment of FIG. 2, such a coupling or attachment mechanism may allow for coupling of cap 20 to container 10 without substantial interference inside of neck 12 and/or opening 11. In some embodiments, a smooth inner surface of neck 12 may facilitate insertion of some or all of flow selector 50.

Figure 3:
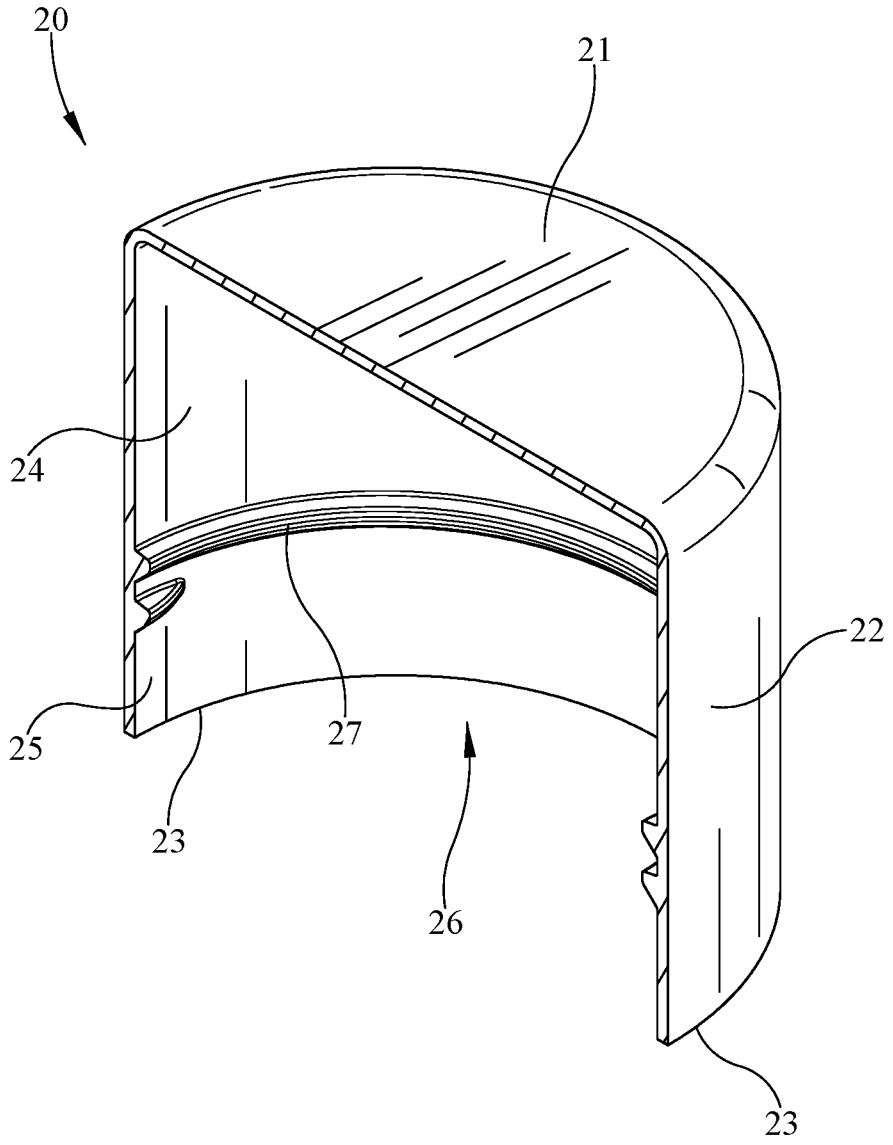
FIG. 3 illustrates a section view of an exemplary embodiment of a cap according to the selective flow package of FIG. 1.

Referring now to FIG. 3, an exemplary cap 20, which may be used with the exemplary container 10 and/or neck 12 described above, is illustrated having a lid 21, a skirt 22, and a bottom edge 23. In some embodiments, cap 20 may be configured to couple with and/or attach to container 10 and/or neck 12, for example, to selectively enclose opening 11 that would otherwise allow access to, and/or ingress or egress of, the contents of selective flow package 5, container 10, and/or product storage region 18. In embodiments having a neck 12 externally threaded with neck thread 13, cap 20 may be internally threaded with cap thread 27. This exemplary coupling mechanism would allow a user to selectively cap and uncap container 10 by rotating cap 20 on and off of neck 12. In this way, for example, a user could close and unclose container 10 to allow or prevent pouring or dispensing of liquid contents or beverage 19 from container 10. Lid 21 of cap 20 may be configured to cover opening 11 and/or to prevent ingress or egress of liquid contents 19 through opening 11 while cap 20 is coupled, attached, and/or secured to container 10 and/or neck 12.

Cap 20 shown in FIG. 3 may include a cavity or recess 26 for at least partially receiving and/or enclosing at least a portion of container 10, such as neck 12, and/or for at least partially receiving and/or enclosing at least a portion of flow selector 50 and/or flow selector 60. For example, cap 20 may include an upper section 24 and/or a lower section 25. If included, upper section 24 and lower section 25 may be separated by cap thread 27. Upper section 24 and/or a corresponding portion of cavity 26 may be sized, shaped, and/or configured to, for example, allow coupling of cap 20 to neck 12 while simultaneously allowing some or all of flow selector 50 to extend above container 10, neck 12, and/or neck thread 13.

Lower section 25 shown in FIG. 3 may extend downwardly from cap thread 27 to correspondingly extend downwardly over a portion of neck 12 that is below neck thread 13 for any of a variety of reasons, including, but not limited to, minimizing or eliminating the longitudinal gap between cap bottom 23 and neck 12. Minimizing or eliminating the longitudinal gap may, for example, give selective flow container 5 a more secure design by making it more difficult to remove cap 20 and/or by making it more difficult to tamper with the contents of container 10 unbeknownst to an end user. It is understood that a tamper evident band, such as a drop type tamper evident band that may be used with a threaded closure, may be included. Furthermore, minimizing or eliminating the longitudinal gap, for example, may give selective flow container 5 a more aesthetically pleasing design. It is understood, of course, that any longitudinal gap between cap bottom 23 and neck 12 may be caused or created and/or sized according to any of a variety of reasons or purposes readily apparent to a person of ordinary skill in the art. It is understood that selective flow package 5 and/or container 10 could be used or provided without cap 20 and/or with a removable or puncturable seal, straw, and/or pop-up spout, for example, instead of or in addition to cap 20, and/or with virtually any mechanism for dispensing or allowing pouring of contents such as liquid contents 19 from container 10 and/or product storage region 18.

FIG. 4 shows an embodiment of a selective flow container 5 with cap 20 removed, showing an embodiment of flow selector 50 coupled to container 10, for example, partially inserted into neck 12 of container 10 and/or adjacent container opening 11 and/or neck 12. Flow selector 50 may be disposed adjacent container opening 11 and/or at least partially interposed between product storage region 18 and container opening 11 and/or the dispensing outlet of package 5 so that it may be used to affect or regulate the flow of beverage or contents 19 from package 5. The dispensing outlet may be at least partially defined by alignment of an opening, such as lid opening 115 in first member 100 with a flow channel in flow regulator 50, such as first flow channel 202 or second flow channel 203. This exemplary flow selector 50 is configured to allow a user to select between a free flow mode and a regulated flow mode. For example, in the free flow mode, the liquid contents 19 of container 10 may be continuously dispensed or poured from container 10 while container 10 is inverted with at least a portion of product storage region 18 above opening 11 and/or neck 12. In this or another example, in the regulated flow mode, the amount of contents poured or dispensed may be limited to a certain and/or predetermined amount of liquid contents 19 (e.g., one to two ounces, or a "shot" of beverage) when container 10 is inverted. A second user input may be provided to move package 5, flow selector 50, and/or flow selector 60 between the upright position and the inverted position, as discussed in more detail below.

Figure 5:
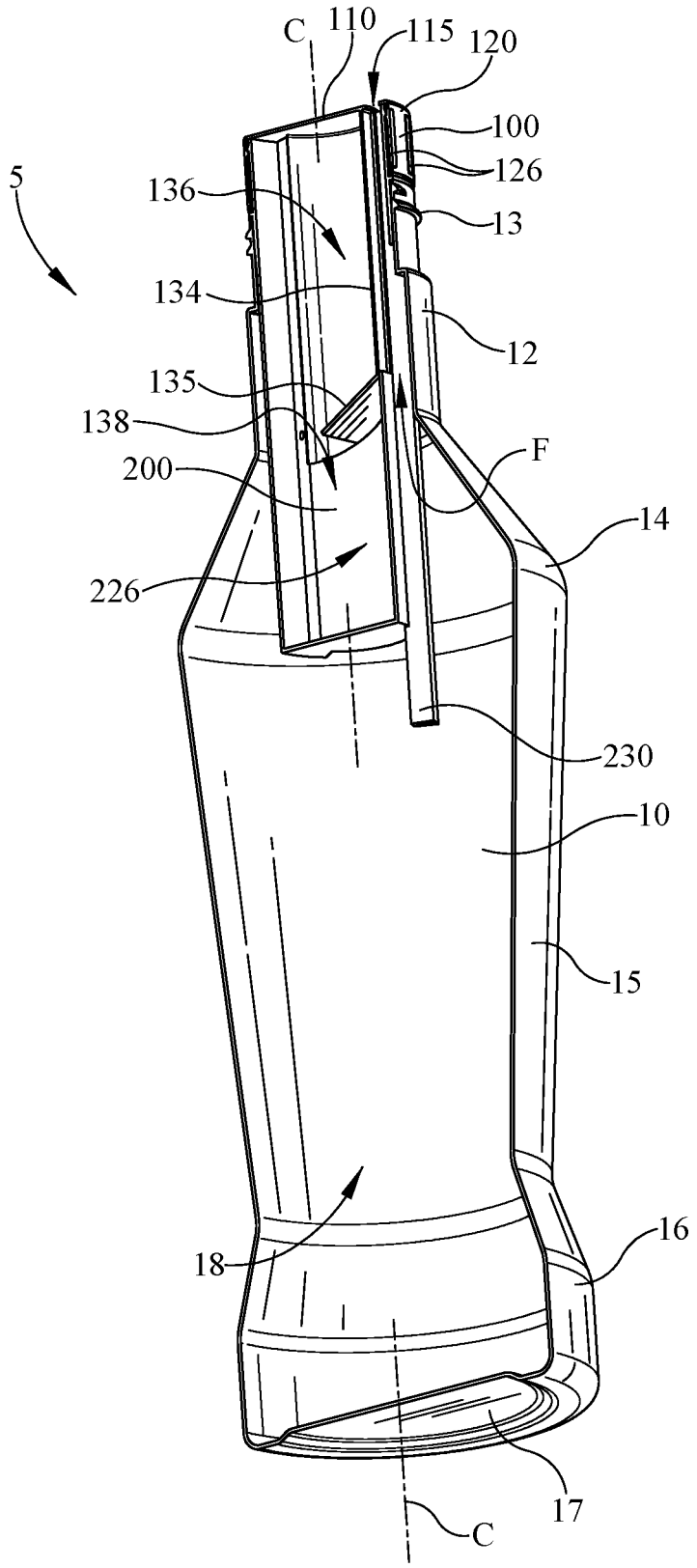
FIG. 5 illustrates a section view of the selective flow package of FIG. 1, with the flow selector of FIG. 4 shown in an exemplary free pour mode.

Flow selector 50 of FIGS. 4 and 5 may include an inner member 100 and/or an outer member 200, which may be movable and/or rotatable relative to one another when subject to a first user input to allow selection of the free flow mode and/or the regulated flow mode by, for example, altering the flow paths from product storage region 18 to the exterior of container 10. In some embodiments, inner member 100 and/or outer member 200 may include a round, circular, or cylindrical portion to facilitate rotation about a rotational or center axis C, which may be a center axis C for package 5 or container 10 in embodiments wherein either or both of these elements include a center axis. For example, inner member 100 may include a first body wall 130 that is at least partially round or cylindrical in shape, and outer member 200 may include a second body 220 that is at least partially round or cylindrical in shape. First body wall 130 may be configured to fit inside second body 220, for example, to allow first body wall 130 and/or inner member 100 to rotate inside of second body 220 and/or outer member 200 similar to a journal bearing or the like.

Inner member 100, for example, may include a lid or cover 110 and/or a cover opening or outlet 115 in cover 110 such as shown in FIGS. 4 and 5. Inner member 100 and/or outer member 200 may at least partially define one or more passages through which liquid contents or beverage 19 may pass or flow. For example, in the regulated flow mode illustrated in FIG. 4, inner member 100 and outer member 200 may cooperate to at least partially form or define a first flow channel or free flow channel 202 and a second flow channel or regulated flow channel 203. In this mode, cover 110 of inner member 100 may be in a first or regulated flow position in which it at least partially covers or blocks first flow channel 202 so that liquid contents 19 cannot be poured or dispensed directly from first flow channel 202 and out of container 10 when container 10 is inverted, for example, with at least a portion of product storage region 18 above neck opening 11. Rather, in this first or regulated flow position, when package 5 is inverted liquid contents 19 may be forced or directed through an outer member side wall opening 223 and an inner member side wall opening 137 into an inner chamber 136 of inner member 100. When selective flow container 5 is re-oriented into a right side up position (e.g., with bottom 17 down into a position where it could rest on a substantially level surface, and/or with at least some of product storage region 18 substantially below neck opening 11), the portion of liquid contents 19 in inner chamber 136 may flow through a floor opening 138 in inner member 100 and into an outer chamber 226 in outer member 200 while the remainder of liquid contents 19 in container 10 return to product storage region 18, for example, via free flow channel 202. When selective flow container 5 is inverted again and/or while there is at least some liquid contents 19 in outer chamber 226, liquid contents 19 may flow through second flow channel 203 and be dispensed or poured through cover 110 via lid or cover opening 115. Lid or cover opening 115 may be used, for example, as a dispensing outlet or container outlet for package 5. In use, for example, liquid contents or beverage 19 may be poured into a drinking glass in a predetermined amount determined and limited by the size of inner chamber 136 and/or outer chamber 226 without requiring the user to limit the amount by, for example, knowing when to stop the pour, timing the pour, or the like.

The amount of liquid or beverage 19 dispensed per pour through the regulated flow mode of the exemplary selective flow container 5 shown in FIG. 4 may be limited, controlled, and/or determined by selectively sizing, shaping, and/or configuring inner chamber 136 and/or outer chamber 226. When container selective flow package 5 is inverted as shown for example in FIG. 16*a*, beverage 19 may flow through the open area provided for by the alignment of inner member side wall opening 137 and outer member side wall opening 223 until reaching approximately the top of the open area or the edge of the open area farthest from inner member cover 110. When the liquid 19 fills inner chamber 136 to about this edge of the open area created by the alignment of side wall openings 137, 223, with neither blocking the passage, liquid 19 may substantially slow or cease filling inner chamber 136 due to increasing air pressure, for example. In this way, the volume of beverage 19 that enters inner chamber 136 while container 10 is inverted in the regulated flow mode may be controlled, limited, and/or determined by sizing the inner member side wall 130 (e.g. the diameter thereof), inner chamber 136, and/or the height or length of the open area provided for by the overlapping and/or aligned portions of inner member side wall opening 137 and outer member side wall opening 223. Alternatively, beverage 19 may fill substantially all or most of chamber 136 and/or chamber 226 while package 5 is inverted, with all or most of the contents of outer chamber 226 dispensed from package 5 via regulated flow channel 203 upon tipping package 5 upright again, and/or with all or most of the contents still in inner chamber 136 re-entering product storage region 18. In the latter case, angled floor 135 may assist in directing beverage 19 from outer chamber 226 to regulated flow channel 203 and/or may assist in directing beverage 19 from inner chamber 136 back to product storage region 18.

Outer chamber 226 shown in FIG. 4 may be sized, shaped, and/or configured to have approximately the volume of inner chamber 136. Outer chamber 226 may be configured to have at least the volume of inner chamber 136. Either or both of inner member 100 and outer chamber 200 may include a wall or partition such as a floor 135. Alternatively, floor 135 may be separate from inner member 100 and/or outer member 200. Floor 135 along with inner member side wall 130 and/or outer member side wall 221 may at least partially define an opening or passage such as floor opening 138 to allow fluid communication between inner chamber 136 and outer chamber 226. Floor 135 may be included for any of a variety of reasons, including, but not limited to, to help direct liquid 19 from inner chamber 136 toward outer chamber 226 when container 10 is moved from an inverted position to an upright position, and/or to help prevent liquid 19 from outer chamber 226 returning to inner chamber 136, rather helping to guide liquid 19 toward second flow channel 203 and/or cover opening 115, when container 10 is re-inverted.

As shown in FIG. 5, inner member 100 and/or cover 110 may be moved into a second or free pour position so that cover opening 115 is at least partially aligned with first flow channel 202 to allow pouring of liquid contents 19 out of container 10 directly through first flow channel 202. In this second or free pour position, liquid contents 19 may substantially bypass inner chamber 136 and/or outer chamber 226 (see, e.g., FIG. 17 for an illustration of an exemplary free flow F). For example, movement or rotation of inner member 100 relative to outer member 200 may cause movement of inner member side wall 130 into a position to at least partially block or occlude outer member side wall opening 223 and/or substantially limit and/or prevent fluid communication between first flow channel 202 and inner chamber 136. In the free pour position, liquid contents 19 may flow or pour out of cover opening 115 continuously, without significant limitation as to the amount or volume allowed to egress from container 10 and/or product storage region 18, while fluid communication is limited or prevented between product storage region 18 and inner chamber 136 (and consequently outer chamber 226). A user may select between the aforementioned regulated flow mode and the aforementioned free flow mode, for example, by moving or rotating inner member 100 about center axis C relative to outer member 200. For example, a user may grab an outer surface or skirt 120 of inner member 100 and twist it to move it selectively between the first or regulated flow position and the second or free flow position. In some embodiments, the outer surface or skirt 120 of inner member 100 may include a grip facilitating or enhancing feature such as exemplary knurls 126 for any of a variety of reasons, including but not limited to making inner member 100 easier to move or rotate by hand.

In some embodiments, first flow channel 202 may be substantially defined between container body 15 (and/or container neck 12) and inner member side wall 130 of inner member 100 and/or an outer body 220 of outer member 200, as illustrated in FIG. 4. Second flow channel 203 may be substantially defined at least partially by or within outer member 200. Second flow channel 203 may be positioned or located away from first flow channel 202, such as, for example, substantially diametrically opposed from first flow channel 202 as shown in FIG. 4. In such embodiments, lid opening 115 may be moved approximately 180 degrees about center axis C from the first or regulated flow position to the second or free flow position to allow a free flow F out of selective flow container 5 as shown in FIG. 5. It is understood that second flow channel 203 may be located other than diametrically opposed from first flow channel 202. For example, second flow channel 203 may be approximately 45 degrees, 90 degrees, 135 degrees, or any other angle away from first flow channel 202. Moreover, it is understood that there may be more than two positions and/or flow channels such as shown in FIGS. 4 and 5.

As shown in FIG. 6, flow selector 50, when in the regulated flow position, may provide for various flows to achieve the purpose of providing a volumetrically regulated flow from selective flow package 5, or for any other reason or any combination of reasons. For example, flow selector 50 may provide a first regulated sub-flow $R_1$, a second regulated sub-flow $R_2$, and/or a third regulated sub-flow $R_3$ through flow selector 50 or any portion thereof when in the regulated flow position. With inner member 100 in a first or regulated flow position relative to outer member 200 and/or with cover opening 115 in alignment with second flow channel 203, selective flow container 5 and/or flow selector 50 may be inverted from an upright position, re-oriented into an upright position, and/or re-inverted to achieve any or all of regulated sub-flows $R_1$-$R_3$. For example, selective flow container 5 may be provided in an upright position and/or at rest on a flat or substantially flat surface or provided in a similar position, such as if container bottom 17 is resting on a table, countertop, bar, ground, or the like, with inner chamber 136 at least partially above outer chamber 226.

From this or a similar upright position, selective flow container 5 may be inverted so that outer chamber 226 is at least partially above inner chamber 136 and/or so that inner chamber 136 is at least partially below the open area provided for by alignment of inner side wall opening 137 and outer side wall opening 223 so that gravity may act, for example, to cause first regulated sub-flow $R_1$ of beverage 19 from product storage region 18 through side wall opening 137 and 223 and into inner chamber 136. First regulated sub-flow $R_1$ may cease, while selective flow package 5 is still in the inverted position, when the level of liquid contents 19 in inner chamber 136 rises to the level of the upper edge or bound of the opening 137 and/or 223 and/or a first volume of liquid 19 has at least partially filled inner chamber 136 and/or 226.

Upon orienting of selective flow container 5 from the aforementioned inverted position or a similar position to the aforementioned upright position or a similar position, gravity may act, for example, to cause second regulated sub-flow $R_2$ of beverage 19 from inner chamber 136 to outer chamber 226 through floor opening 138, as indicated in FIG. 6. The first volume of beverage 19 from inner chamber 136 may move to outer chamber 226. The volume of beverage 19 transferred by sub-flow $R_2$ may be substantially the same or similar as the volume transferred by sub-flow $R_1$, although it is understood that it could be a different volume depending on the size, shape, or other characteristics of flow selector 50 or any component thereof.

When selective flow container 5 is inverted again and/or while outer chamber 226 contains the first volume of beverage 19, third regulated sub-flow $R_3$ may be provided from outer chamber 226 through second flow channel 203, and out of selective flow container 5 via cover opening 115, as indicated in FIG. 6. While inverted with beverage 19 exiting selective flow container 5 in the form of third regulated sub-flow $R_3$, inner chamber 136 may again fill via another first regulated sub-flow $R_1'$. In some embodiments, inner chamber 136 may be primed or filled the first time selective flow container 5 is inverted although if outer chamber 226 is empty substantially no liquid may egress from selective flow container 5. In such embodiments, third regulated sub-flow $R_3$ may be achieved to pour from selective flow container 5 with each inversion after the first inversion when selective flow container 5 is inverted until beverage 19 is substantially depleted from product storage region 18, as will be readily understood by one of ordinary skill in the art. It is understood that package 5 may be provided to a user with some contents or beverage 19 already in flow selector 50, or already primed, so that beverage 19 is dispensed upon the first inversion. It is further understood that some residual beverage 19 may remain that is difficult to pour from package 5 after most or all productive pours.

As shown in FIG. 7, flow selector 50 may be provided or located in the second or free flow position. In this position or configuration, a portion 134 of inner side wall 130 blocks or occludes opening 223 in outer member 200 while cover opening 115 simultaneously is aligned with first flow channel 202 to allow fluid communication or egress of liquid contents 19 from product storage region 18 to the exterior of selective flow container 5. In this position or configuration, a free flow F is achieved from product storage region 18 through first flow channel 202 and out of selective flow container 5 via cover opening 115.

Referring briefly back to FIGS. 4 and 5, flow selector 50 may be configured to be at least partially insertable into container 10, for example, into neck 12. FIGS. 6 and 7 illustrate flow selector 50 separate from container 10 to show certain features in more detail. The exemplary inner member 100 and outer member 200 shown in FIGS. 6 and 7 illustrate how inner member 100 and outer member 200 may fit together and/or cooperate to provide for a regulated flow position and a free flow position as discussed above, as well as how inner member 100 and outer member 200 may be provided to interact with container 10 or any portion thereof.

Figure 11:
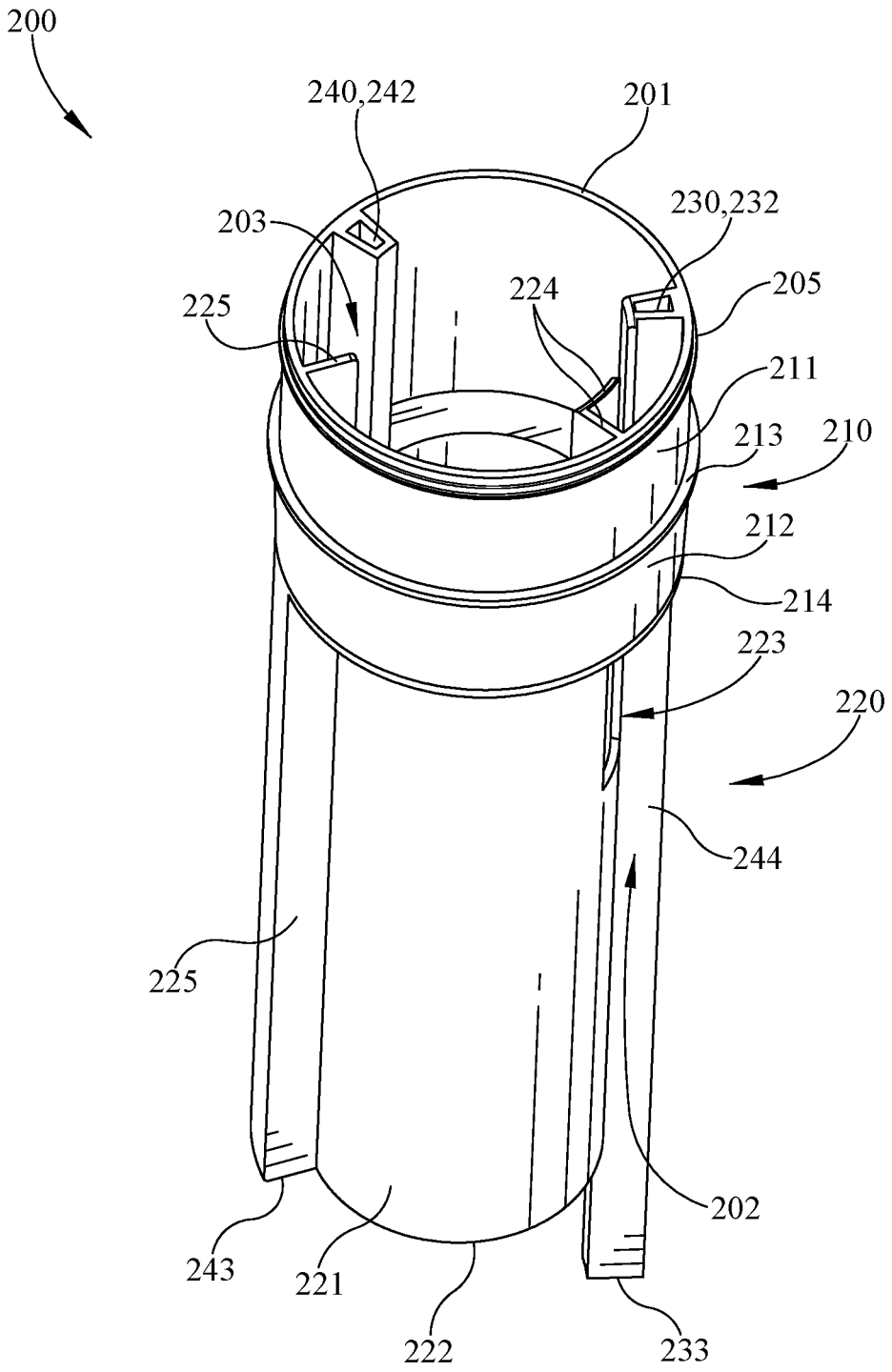
FIG. 11 illustrates a perspective view of an exemplary outer member of the flow selector of FIG. 4.
Figure 12:
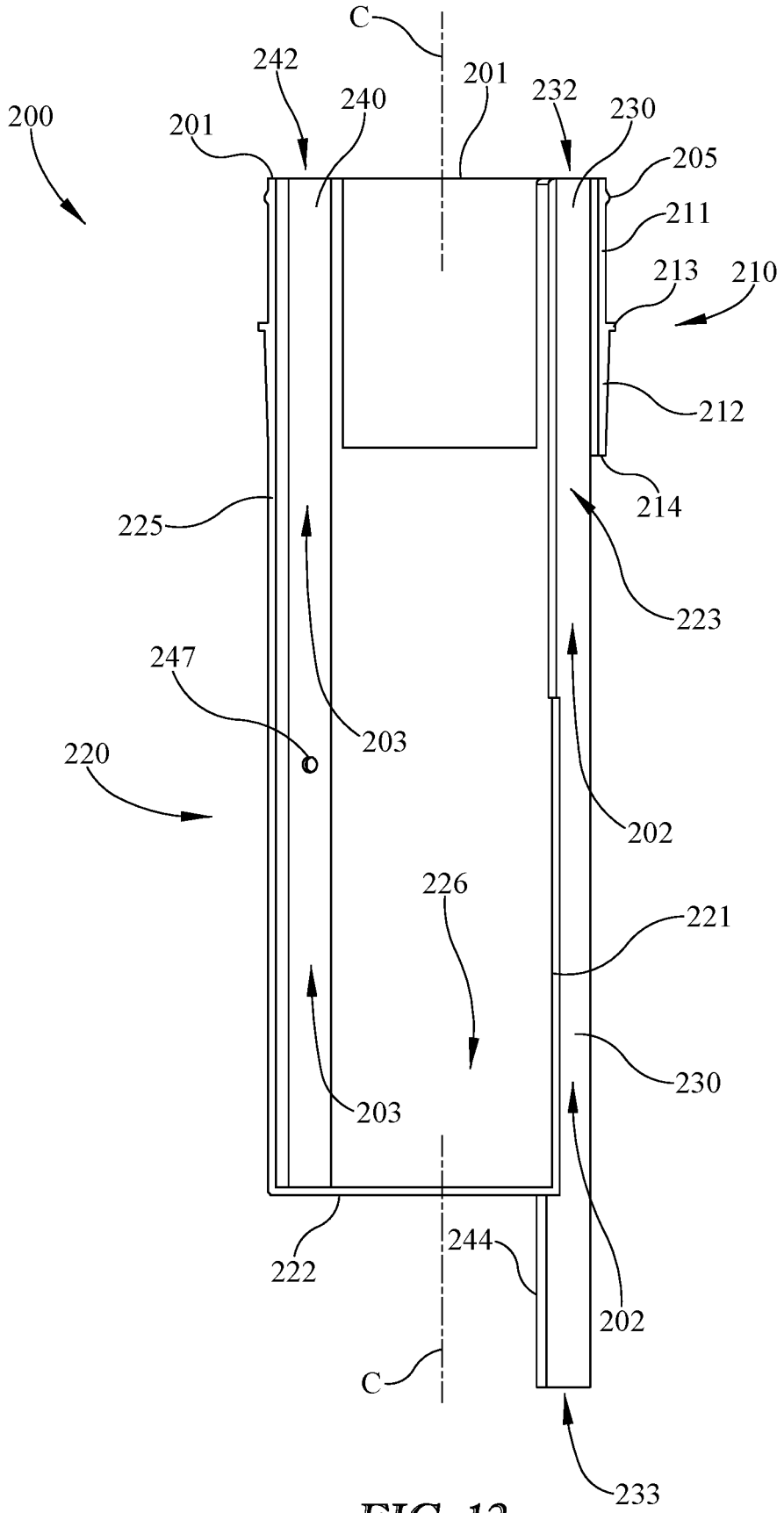
FIG. 12 illustrates a section view of the outer member of FIG. 11.

As shown in FIGS. 6 and 7, with reference to FIGS. 11 and 12, outer member 200 may have an attachment portion 210 that may include an upper portion 211 and/or a lower portion 212, which may be separated, for example, by an outwardly protruding rib 213. Lower portion 212 may terminate at a downward or lower end, when oriented in the upright position, in a bottom edge 214. Lower portion 212 may be tapered, beveled, and/or chamfered or the like, for example, to facilitate insertion into neck 12 of container 10.

Rib 213 may be sized, shaped, and/or configured to abut a rim or top of neck 12 and/or to stop further insertion of lower portion 212 and/or outer member 200 into neck 12. Lower portion 212 may form a friction or interference fit with neck 12 and/or an inner surface thereof, in some embodiments. Outer member 200 may be otherwise attached and/or coupled to container 10 and/or neck 12 instead of or in addition to such a friction or interference fit. Inner member 100 may be snap fit or interference fit, for example, onto outer member 200. For example, outer member 200 may have a bead, groove, or recess, or the like adapted to form a snap fit with a corresponding feature on inner member 100. Upper section 211 of outer member 200 may be sized, shaped, and/or configured to provide for skirt 120 of inner member 100, such as the surface including knurls 126, to at least partially overlap upper section 211 and provide, for example, a grippable outer surface of inner member 100 by which a user may rotate inner member 100 relative to outer member 200 by hand. In some embodiments, inner member 100 may be substantially attached and/or coupled to outer member 200 such that it is difficult or impossible to separate inner member 100 from outer member 200 while inner member 100 is still allowed to move or rotated relative to outer member 200.

Figure 8:
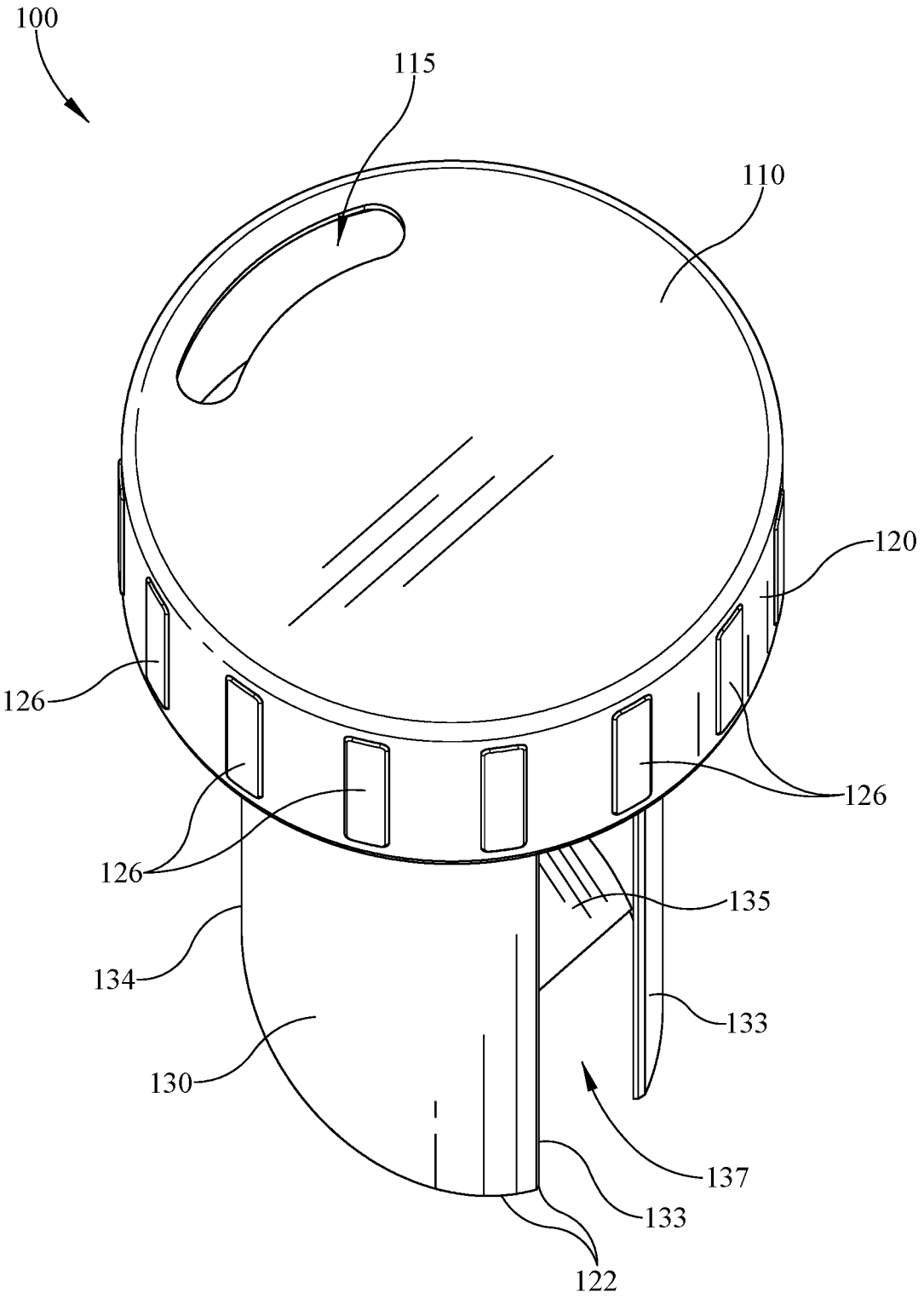
FIG. 8 illustrates a top perspective view of an exemplary inner member of the flow selector of FIG. 4.
Figure 9:
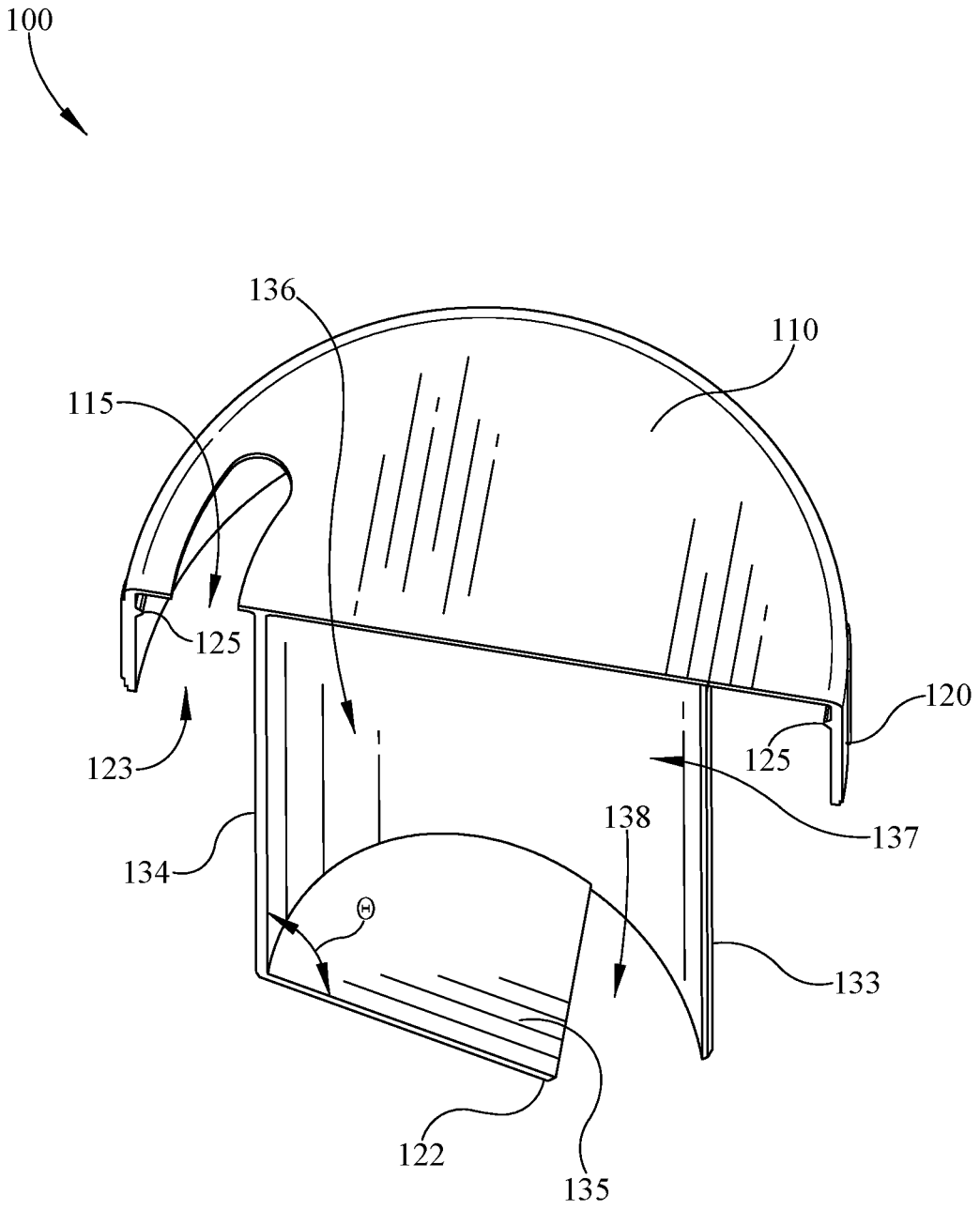
FIG. 9 illustrates a section view of the inner member of FIG. 8.
Figure 10:
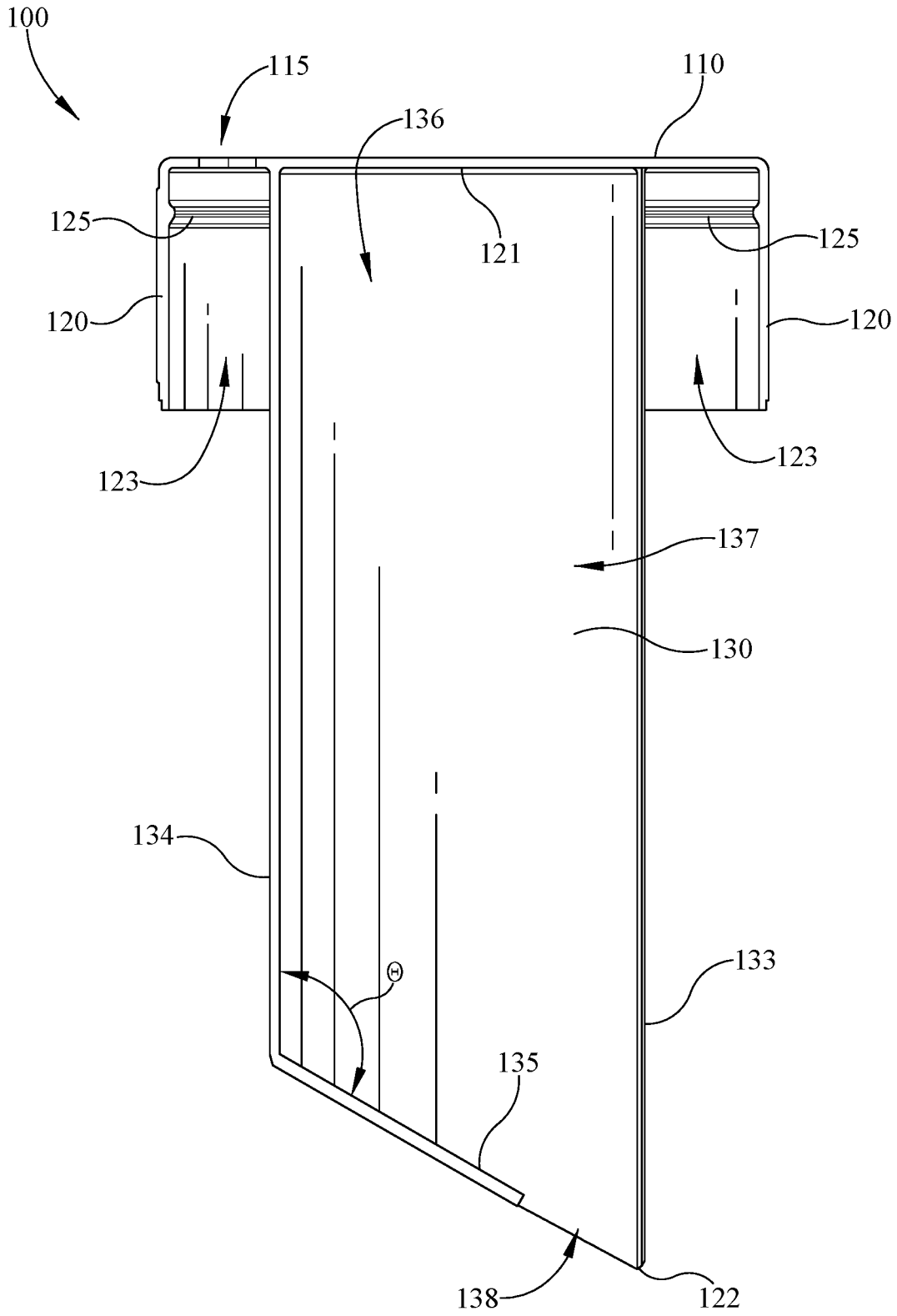
FIG. 10 illustrates another section view of the inner member of FIG. 8.

Referring now to FIGS. 8-10, an exemplary embodiment of inner member 100 is shown separate from outer member 200 to illustrate inner member 100 in additional detail. Inner member 100 may extend between cover 110 and an inner member bottom 122. As discussed above, inner member 100 may be substantially round or cylindrical, with a body 130 insertable and rotatable within at least a portion of outer member 200. Inner member 100 may include an inner member cavity 123 for receiving some or all of outer member 200, such as upper section 211, for example, forming a press or friction fit between upper section 211 and lid skirt 120 while allowing relative rotation of inner member 100 and outer member 200. Additionally and/or alternatively, inner member 100 may include an inner attachment feature 125 such as a snap bead or groove that may correspondingly engage, fasten to, couple to, and/or attach to an outer attachment feature 205 such as a corresponding groove or snap bead configured to correspond with inner attachment feature 125 (exemplary outer attachment feature 205 is shown in FIGS. 11 and 12).

Inner member 100 may include skirt with outer surface 120, which may include one or more knurls 126 or the like to facilitate gripping and/or rotating of inner member 100 relative to outer member 200 and/or container 10, as shown for example in FIGS. 8-10. Inner wall opening 137 may be sized, shaped, and configured to be moved or rotated into or out of alignment with an opening in outer member side wall 221 to allow or prevent flow of liquid contents 19 as discussed above. Floor 135 may be provided at an angle θ relative to inner member side wall 130 to facilitate flow of liquid contents 19 and/or to guide liquid contents 19 from inner chamber 136 toward outer chamber 226 and/or to inhibit back flow of liquid contents from outer chamber 226 toward inner chamber 136. In exemplary embodiments, angle θ may be in the range of about 90 to 160 degrees, in the range of about 90 to 140 degrees, in the range of about 100 to 160 degrees, in the range of about 90 to 120 degrees, in the range of about 120 to 160 degrees, in the range of about 110 to 150 degrees, in the range of about 110 to 130 degrees, and/or about 120 degrees as is approximately illustrated in the exemplary figures. Angle θ may be less than about 90 degrees. It is understood that, in embodiments where angle θ is other than about 90 degrees, inner member 100 may have sides of varying length. For example, in embodiments where angle θ is greater than about 90 degrees, inner member 100 may have a long side 133 and/or a short side 134, short side 134 may be near the junction of floor 135 with first body wall 130, long side 133 may be opposite the junction of floor 135 with first body wall 130, and/or long side 133 may be near floor opening 138. It is understood that first body wall 130 may extend below floor 135 on or more sides and/or first body wall may have a substantially uniform length, if desired.

FIGS. 11 and 12 show an exemplary outer member 200 separate from inner member 100 and container 10 to show features of outer member 200 in additional detail. Outer member 200 may extend between a rim 201 and a floor or bottom 222 and/or a bottom opening or end 233 of a first aerator tube 230. First aerator tube 230 may be at least partially defined by a tube side wall 244. Outer member side wall opening 223 may be provided in a substantially cylindrical or round outer member side wall 221 to allow fluid communication and/or flow of liquid contents 19 from product storage region 18 and/or first flow channel 202 into inner chamber 136. To facilitate release of air pressure build-up and/or to facilitate flow, first aerator tube 230 and/or a second aerator tube 240 may be included, for example, in outer member 200. First aerator tube 230 may have an open top end 232 and/or open bottom end 233. Second aerator tube 240 may have an open top end 242 and/or an open bottom end 243. Either or both of bottom ends 233, 243 may extend below bottom 222 and/or side wall opening 223 of outer member 200, though it may alternatively not extend below bottom 222 or opening 223. Second flow channel 203 may be provided substantially by a radially outwardly protruding side wall 225 in outer member 200, which may project outwardly from body side wall 221. In this way, for example, a substantially cylindrical sleeve or journal bearing mechanism may be provided in outer member 200 via cylindrical side wall 221 to allow rotation of inner member 100 or a portion thereof in outer member 200, while also providing second flow channel 203 substantially radially equidistant from center axis C as compared to first flow channel 202. A vent hole 247 may be provided in second aerator tube 240 for any of a variety of reasons, including, but not limited to, to equalize or release air pressure and/or to allow or facilitate flow of regulated sub-flow $R_3$ through second flow channel 203.

FIGS. 13-15 show an example of an alternative embodiment of a flow selector 60 that may be used in a container, such as container 10 discussed elsewhere herein, for example. Flow selector 60 may operate generally in a similar manner to flow selector 50 discussed above. Flow selector 60 may include an inner member 300 that may operate similarly to inner member 100 discussed above, and/or flow selector 60 may include an outer member 400 that may operate similarly to outer member 200 discussed above. FIGS. 13-15 illustrate flow selector 60 in a regulated or controlled flow position, with a lid 310 of inner member 300 blocking a first or free flow channel 402 of outer member 400 (see FIG. 14). In this position, similar to the regulated or controlled flow position of flow selector 50 discussed above, an inner chamber 336 of inner member 300 may be in fluid communication with the interior or product storage region 18 of container 10, for example, via an inner member side wall opening 337 in an inner member side wall 330 and an outer member side wall opening 423 in an outer member side wall 420 (see FIG. 15).

Alignment of inner member side wall opening 337 and outer member side wall opening 423, for example as shown in FIG. 15, may allow fluid communication from product storage region 18 into inner chamber 336, for example when package 5 is inverted, while direct dispensing from product storage region 18 through free flow channel 402 through lid opening 315 is substantially blocked in the regulated flow position as shown. In this exemplary regulated flow position, fluid contents may be communicated from inner chamber 336 to a second or outer chamber 426 substantially defined by outer member side wall 420 and at or below an inner member floor 335, for example, when package 5 is turned right side up again from an inverted position. Similar to floor 135 and opening 138 in flow selector 50, flow selector 60 may include a floor 335 angled relative to side wall 330 at an angle $\theta_2$, and/or an opening 338 providing fluid communication between inner chamber 336 and outer chamber 426. While it is understood that floor 335, opening 338, and/or angle $\theta_2$ in flow selector 60 may be configured independently of similar features of flow selector 50 (e.g., floor 135, opening 338, angle $\theta$), the description as it relates to these features of flow selector 50 may also apply to the similar features of flow selector 60. For example, floor 335 may be angled at any of a variety of angles 02 (e.g., 90-160 degrees, or about 120 degrees, or the like, as discussed above in relation to angle $\theta$ of floor 135) for any of a variety of reasons including but not limited to facilitating flow from inner chamber 336 to outer chamber 426 while flow selector 60 is in the upright position, and/or facilitating flow from outer chamber 426 through regulated flow channel 403 when flow selector 60 is in the inverted position.

Upon inverting package 5, fluid contents may be communicated out of outer chamber 426 through regulated or second flow channel 403, which may be substantially defined by a second flow channel side wall 425 in outer member 400, and through an opening 315 in an inner member lid 310. Inner member 310 may include a skirt 320 and/or one or more knurls 326. Inner member 300 may be substantially identical to inner member 100, although it is understood that they may vary in size, shape, orientation, or any other characteristic or combination thereof.

Primary differences between flow selector 50 and flow selector 60, shown and discussed for illustrative purposes only and not intended to limit the structure of either flow selector 50 or flow selector 60, are discussed with reference to FIG. 14. An outlet of first or free flow channel 402 in flow selector 60 is shown closer to second flow channel side wall 425 and/or second flow channel 403 than it is shown with regard to flow selector 50. Comparing, for example, flow selector 50 as shown in FIG. 4 to flow selector 60 as shown in FIG. 14, it can be seen that inner member 100 of flow selector 50 is rotated approximately 180 degrees relative to outer member 200 to change between the free flow position and the regulated flow position, whereas inner member 300 of flow selector 60 is rotated about 60 to about 90 degrees relative to outer member 400 to change between the free flow position and the regulated flow position. It is understood that these locations and/or the degrees of rotation to change between free and regulated flow positions or conditions are exemplary, and any of a variety of relative positions may be used.

Moreover, flow selector 60 may include an aerator tube 430 as shown in FIG. 14. As depicted in FIG. 14, flow selector 60 may, for example, include a single aerator tube 430 that may be substantially shorter than second flow channel side wall 425. In this embodiment, aerator tube 430 may be used to aerate or reduce glugging when pouring fluid contents from flow selector 60 and/or package 5. Furthermore, lid opening 315 may be sized and/or shaped so that it may leave aerator tube 430 substantially unblocked whether pouring from the free flow position or the regulated flow position. For example, in the free pour position, lid opening 315 may be positioned over the outlet of free flow channel 402 and over aerator tube 430 to help reduce glugging while pouring from the free pour position. Continuing this example, lid opening 315 may be rotated so that it no longer is over free flow channel 402, with free flow channel 402 now blocked by lid 310, and rather lid opening 315 may be over regulated flow channel 403 and/or regulated flow channel side wall 425, lid opening 315 may again leave aerator tube 430 substantially uncovered to reduced glugging. It is understood that aerator tube 430 is optional and flow selector 60 or flow selector 50 may be provided without an aerator tube, and that alternatively virtually any number of aerator tubes may be included. If one or more aerator tubes 230, 240, 430 are included in either or both of the illustrated embodiments of a flow selector 50, 60, it is understood that the aerator tube(s) may be of virtually any size, shape, and/or length and those shown in the various figures are merely exemplary.

Figure 16C:
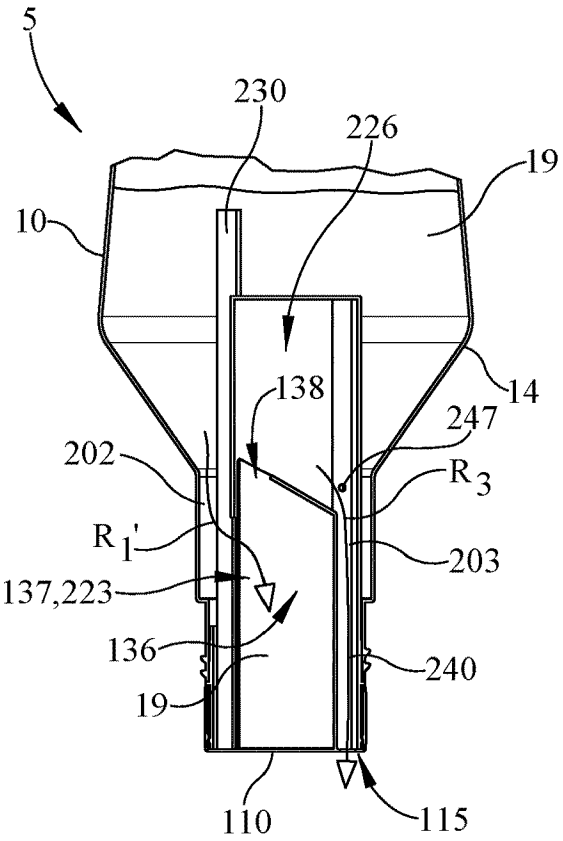
FIG. 16*c* illustrates a partial section view of the selective flow package of FIG. 16*a* in the inverted position with the flow selector in the regulated flow mode to communicate liquid contents from the outer chamber through a flow channel to dispense the liquid contents from the selective flow package, while liquid contents are again communicated from the container to the inner chamber.
Figure 16B:
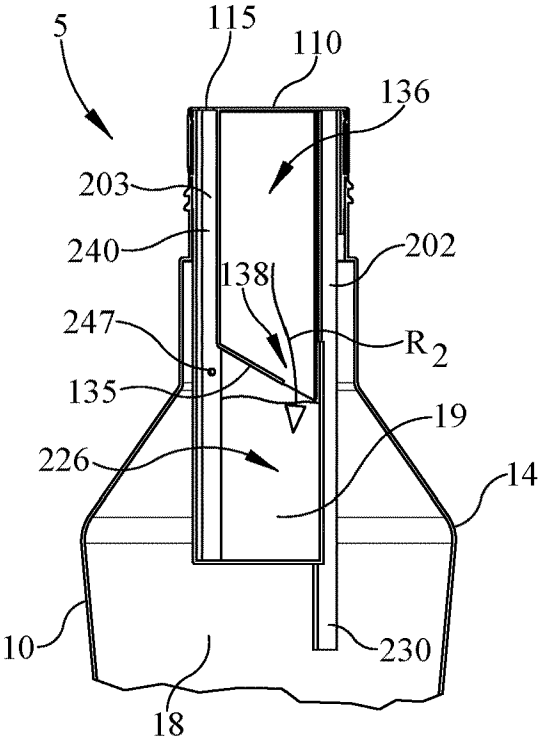
FIG. 16*b* illustrates a partial section view of the selective flow package of FIG. 16*a* in an exemplary upright position with the flow selector in the regulated flow mode to communicate liquid contents from the inner chamber to an outer chamber.
Figure 16A:
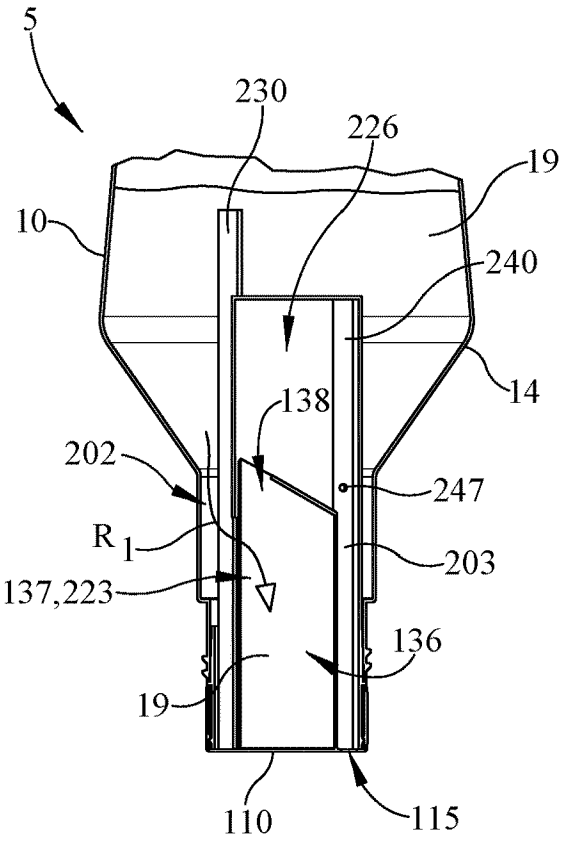
FIG. 16*a* illustrates a partial section view of the selective flow package of FIG. 4 in an exemplary inverted position with the flow selector in the regulated flow mode to communicate liquid contents from the container to an inner chamber.
Figure 17:
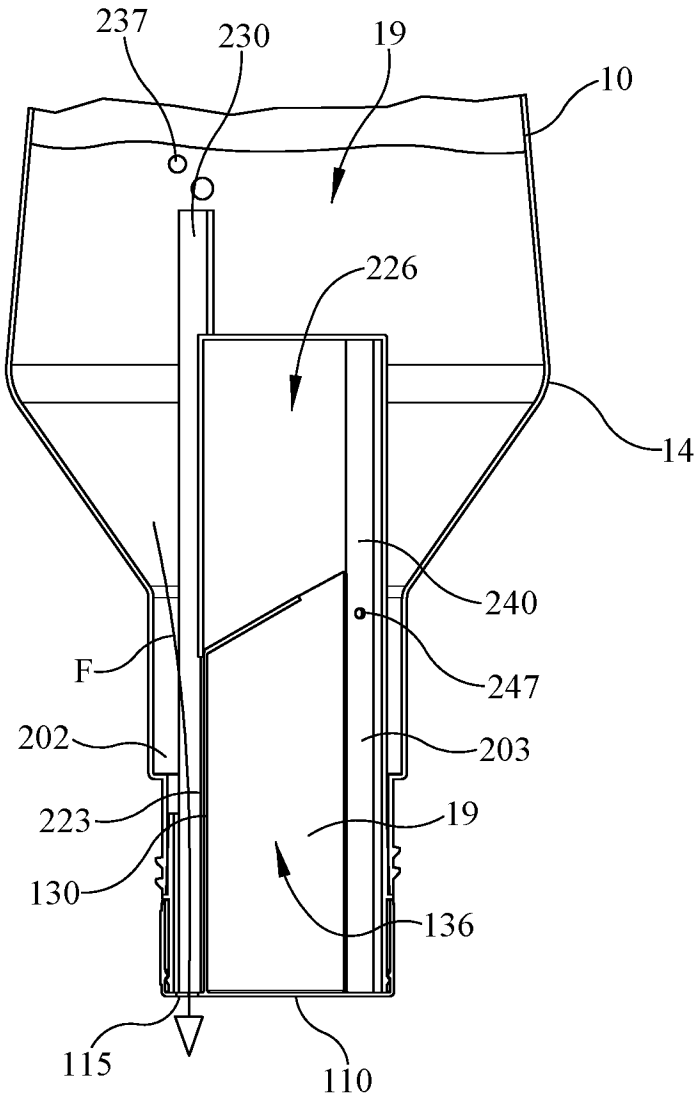
FIG. 17 illustrates a partial section view of the selective flow package of FIG. 4 in an exemplary inverted position with the flow selector in the free pour mode to communicate liquid contents from the container through a flow channel, bypassing the inner chamber and outer chamber, to dispense the liquid contents from the selective flow package.

FIGS. 16*a*-16*c* illustrate exemplary use of flow selector 50 in container 10 to dispense or pour beverage 19 in a regulated, limited, or controlled amount, while flow selector 50 is in the first or regulated flow position. As discussed above, FIG. 16*a* illustrates selective flow package 5 in an exemplary inverted position to allow liquid contents 19 to fill inner chamber 136 via first regulated sub-flow $R_1$. FIG. 16*b* illustrates selective flow package 5 returned to an exemplary upright position following filling inner chamber 136 at least partially as shown in FIG. 16*a*. In FIG. 16*b*, regulated sub-flow $R_2$ is provided to transfer liquid contents 19 from inner chamber 136 to outer chamber 226. FIG. 16*c* illustrates re-inverting of selective flow package 5 to simultaneously provide for pouring or dispensing of a controlled, limited, or regulated volume of liquid contents out of selective flow package 5 via third regulated sub-flow $R_3$. In FIG. 16*c*, contemporaneously with third regulated sub-flow $R_3$, a subsequent first regulated sub-flow $R_1'$ again fills at least partially inner chamber 136 to start the regulated flow process again. In exemplary embodiments, regulated sub-flows $R_1$-$R_3$ according to FIGS. 16*a*-16*c* may be used to repeatedly dispense a controlled or limited volume, for example, an ounce or shot of beverage 19.

FIG. 17 illustrates exemplary flow selector 50 in the second or free flow position while in container 10 to dispense or pour beverage 19 freely or in free pour mode, as indicated by free flow F. As discussed above, inner chamber 136 and outer chamber 226 are substantially bypassed in free flow mode, as the side wall openings are not aligned, and/or liquid contents 19 are allowed to egress container 10 substantially without limitation by alignment of lid opening 115 with first or free flow channel 202. FIG. 17 shows an exemplary air pocket or bubble 237 escaping via first aerator tube 230 as ambient air replaces dispensed beverage 19 poured from container 10. It is understood that the description of use with flow selector 50, for example with reference to FIGS. 16*a*-16*c* and FIG. 17, may substantially apply to the use or operation of flow selector 60 and/or other embodiments of a flow selector. For example, lid opening 315 of flow selector 60 may align with first or free flow channel 402 to allow free flow F out of flow selector 60, and/or in this free flow mode first member side wall 330 may substantially block opening 423, as openings 337 and 423 may not be aligned, to substantially limit or prevent fluid communication from product storage region 18 to first chamber 336 and/or second chamber 426.

It is understood that bottle or container 10 and/or any component thereof may be made of any of a variety of materials, including, but not limited to, any of a variety of suitable plastics material, any other material, or any combination thereof. Suitable plastics material may include, but is not limited to, polyethylene terephthalate (PET), polyethylene (PE), polypropylene (PP), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that bottle 10 or any component thereof may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of bottle 10.

It is further understood that any of a variety of processes or combination thereof may be used to form bottle 10, any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, bottle 10 and/or any component thereof may be formed substantially of injection stretch blow molded PET, although other materials and forming processes may be used instead of or in addition to PET and injection stretch blow molding, respectively. Various materials and/or processes may be used to form bottle 10 and/or any component thereof as will be understood by one of ordinary skill in the art. In some embodiments, bottle 10 may be substantially a one-piece design and/or substantially formed as an integral or unitary structure.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A selectively flow regulating container, comprising:

a container having a base, a side wall, and a container opening, wherein the base and the side wall define a product storage region;

a flow regulator coupled to the container and disposed adjacent the container opening, the flow regulator having a first member and a second member, wherein the first member is movable relative to the second member between a regulated flow position and a free flow position; and the first member having a first wall defining a first chamber and a first opening in the first wall, and the second member having a second wall defining a second chamber and a second opening in the second wall;

wherein in the regulated flow position the product storage region is in fluid communication with the first chamber via an open area provided by alignment of at least a portion of the first opening and at least a portion of the second opening when the container is inverted, and the second chamber is in fluid communication with an exterior of the container via a dispensing outlet when the container is inverted;

wherein in the regulated flow position the first chamber is in fluid communication with the second chamber when the container is upright;

wherein in the regulated flow position a flow from the product storage region to the exterior of the container is substantially blocked by at least one of the first member and the second member, which cooperate to redirect the flow through at least one of the first chamber and the second chamber in the regulated flow position;

wherein in the free flow position the product storage region is in fluid communication with the dispensing outlet of the container.

2. A selective flow regulator, comprising:

a first member and a second member configured to be movably coupled to the first member, wherein the coupled first member and second member are configured to be inserted together into an opening of a container;

the first member having a first wall defining a first chamber and a first opening in the first wall, and the second member having a second wall defining a second chamber and a second opening in the second wall;

the first member selectively movable by a first user input relative to the second member between a regulated flow position and a free flow position, wherein the first and second members are selectively movable by a second user input between an upright position and an inverted position, wherein in the upright position the inner chamber is above the outer chamber and wherein in the inverted position the inner chamber is below the outer chamber;

the first member having a lid configured to block flow out of the first member except at a lid opening configured for dispensing contents through the lid;

wherein in the free flow position a first channel is at least partially defined by the first wall and the second wall, wherein in the free flow position fluid flow from the first channel to the first chamber is blocked while the pour opening is in fluid communication with the first channel to allow fluid flow from the first channel through the lid opening;

wherein in the regulated flow position the lid of the first member blocks fluid flow from exiting the lid from the first channel, wherein the first wall opening and the second wall opening are at least partially aligned to allow fluid communication between the first channel, the first chamber, the second chamber, and the lid opening when the first and second members are in the inverted position; and wherein the first chamber is in fluid communication with the second chamber when the first and second members are in the upright position.

3. A selective flow regulator, comprising:

a first member and a second member configured to be rotationally coupled to the first member, wherein the coupled first member and second member are configured to be inserted together into an opening of a container;

the first member having a first side wall at least partially defining an inner chamber, the first side wall having a first opening, and the first member having a floor at least partially defining a floor opening;

the second member having a second side wall at least partially defining an outer chamber, the second side wall having a second opening;

the first member selectively rotatable by a first user input relative to the second member between a regulated flow position and a free flow position, wherein the first and second members are selectively movable by a second user input between an upright position and an inverted position, wherein in the upright position the inner chamber is at least partially above the outer chamber and wherein in the inverted position the inner chamber is at least partially below the outer chamber;

the first member having a lid configured to block flow out of the first member except at a lid opening configured for dispensing contents through the lid;

wherein in the free flow position a first channel is at least partially defined by the first side wall and the second side wall and located external of the first side wall and the second side wall, wherein in the free flow position fluid flow from the first channel to the inner chamber is blocked while the pour opening is in fluid communication with the first channel to allow fluid flow from the first channel through the lid opening;

wherein in the regulated flow position the lid of the first member blocks fluid flow from exiting the lid from the first channel, wherein the first side wall opening and the second side wall opening are at least partially aligned to allow fluid communication between the first channel and the inner chamber when the first and second members are in the inverted position;

wherein the floor opening in the first member at least partially provides fluid communication between the inner chamber and outer chamber at least when the first and second members are in the upright position; and a second flow channel at least partially defined by the first side wall and the second side wall and located between the first side wall and the second side wall;

the second flow channel in fluid communication with the outer chamber and the lid opening when in the regulated flow position to allow fluid flow from the outer chamber through the second flow channel and to be dispensed through the lid opening when in the inverted position.

4. The selectively flow regulating container of claim 1, further comprising a first aerator tube.

5. The selectively flow regulating container of claim 1, wherein the first member rotates relative to the second member between the free flow position and the regulated flow position.

6. The selectively flow regulating container of claim 1, wherein the first member includes a floor at least partially defining a floor opening.

7. The selective flow regulator of claim 2, wherein the first member is selectively movable by a first user input relative to the second member between a regulated flow position and a free flow position by rotating the first member relative to the second member.

8. The selective flow regulator of claim 7, wherein the second member is relatively rotationally affixed to the container and the first member rotates relative to the second member and the container between the free flow position and the regulated flow position.

9. The selective flow regulator of claim 2, further comprising a first aerator tube.

10. The selective flow regulator of claim 9, wherein the first aerator tube extends beyond a floor of the second member.

11. The selective flow regulator of claim 9, further comprising a second aerator tube.

12. The selective flow regulator of claim 2, wherein the first member includes a floor at least partially defining a floor opening.

13. The selective flow regulator of claim 12, wherein the first member floor is angled relative to the first member side wall.

14. The selective flow regulator of claim 13, wherein the first member floor is angled relative to the first member side wall at an angle in the range of approximately 90 degrees to approximately 160 degrees.

15. The selective flow regulator of claim 14, wherein the first member floor is angled relative to the first member side wall at an angle of about 120 degrees.

16. The selective flow regulator of claim 2, wherein at least one of the first chamber and second chamber are configured to dispense a predetermined amount of contents.

17. The selective flow regulator of claim 16, wherein the predetermined amount of contents is in the range of about 1 ounce to about 2 ounces.

18. The selective flow regulator of claim 16, wherein the other of the at least one of the first chamber and second chamber is configured to dispense a predetermined amount of contents.

19. The selective flow regulator of claim 3, wherein the first member floor is angled relative to the first member side wall.

20. The selective flow regulator of claim 3, wherein at least one of the inner chamber and outer chamber are configured to dispense a predetermined amount of contents.

* * * * *